US009061194B2

(12) United States Patent
Iglehart

(10) Patent No.: US 9,061,194 B2
(45) Date of Patent: Jun. 23, 2015

(54) MOBILE, PORTABLE, AND INTERACTIVE EXERCISE APPARATUS

(71) Applicant: Thomas Iglehart, Webster, TX (US)

(72) Inventor: Thomas Iglehart, Webster, TX (US)

( * ) Notice: Subject to any disclaimer, the term of this patent is extended or adjusted under 35 U.S.C. 154(b) by 119 days.

(21) Appl. No.: 13/950,589

(22) Filed: Jul. 25, 2013

(65) Prior Publication Data

US 2014/0309082 A1 Oct. 16, 2014

Related U.S. Application Data

(60) Provisional application No. 61/810,759, filed on Apr. 11, 2013.

(51) Int. Cl.

| | |
|---|---|
| ***A63B 69/34*** | (2006.01) |
| ***A63B 69/32*** | (2006.01) |
| ***A63B 24/00*** | (2006.01) |
| ***A63B 69/20*** | (2006.01) |

(52) U.S. Cl.

CPC ..... *A63B 69/32* (2013.01); *A63B 24/0062* (2013.01); *A63B 69/203* (2013.01); *A63B 2024/0068* (2013.01); *A63B 2220/53* (2013.01)

(58) Field of Classification Search

CPC ..... A63B 69/004; A63B 69/34; A63B 2244/102; A63B 69/201

USPC ..... 482/83–90

See application file for complete search history.

(56) References Cited

U.S. PATENT DOCUMENTS

| | | | | |
|---|---|---|---|---|
| 1,049,835 | A | 1/1913 | Finney | |
| 4,207,087 | A | 6/1980 | Morrison et al. | |
| 5,437,590 | A | 8/1995 | D'Alto | |
| 5,733,193 | A | 3/1998 | Allard et al. | |
| 5,788,613 | A | 8/1998 | Grimaldi | |
| 5,863,278 | A | 1/1999 | Chen | |
| 5,897,466 | A | 4/1999 | Capach | |
| 5,902,217 | A | 5/1999 | Schechner et al. | |
| 5,941,801 | A | 8/1999 | D'Alto | |
| 5,944,639 | A * | 8/1999 | Ray | 482/87 |
| 6,027,435 | A | 2/2000 | Nadorf et al. | |
| 6,106,443 | A | 8/2000 | Kuo | |
| D440,269 | S | 4/2001 | Thomas | |
| 6,220,992 | B1 | 4/2001 | Shafik | |
| 6,234,940 | B1 | 5/2001 | Fotsis | |
| 6,241,640 | B1 | 6/2001 | Chu | |
| 6,251,051 | B1 | 6/2001 | Chen | |
| 6,302,831 | B1 | 10/2001 | Henry | |
| 6,348,028 | B1 | 2/2002 | Cragg | |
| 6,432,027 | B1 | 8/2002 | Haselrig | |
| 6,790,167 | B1 | 9/2004 | Carlin et al. | |
| 6,994,658 | B2 | 2/2006 | Laudenslager et al. | |
| 7,044,895 | B1 * | 5/2006 | Iglehart | 482/83 |
| 7,278,957 | B2 | 10/2007 | Ghim | |
| 7,458,919 | B2 * | 12/2008 | Giusti | 482/87 |

(Continued)

*Primary Examiner* — Glenn Richman

(74) *Attorney, Agent, or Firm* — Greenberg Traurig, LLP

(57) ABSTRACT

A mobile/portable multifunction and interactive exercise apparatus which may be usable as a mobile/portable striking apparatus and/or a mobile/portable speed bad apparatus, or both. The disclosed embodiments comprise conversion features and components, and utilize an attachment-free leverage application to create a temporary anchoring for the apparatus. Some disclosed embodiments further comprise an electronic interactive user features and components, and utilize impact sensors, a control unit, and a microprocessor for controlling the play of one or more interactive programs/games in which a participant may play against the control unit or against another participant.

20 Claims, 18 Drawing Sheets

(56) References Cited

U.S. PATENT DOCUMENTS 7,909,749 B2 3/2011 Sheedy
7,922,628 B2 * 4/2011 Gonzalez ..... 482/90
8,029,422 B2 * 10/2011 Strong et al. ..... 482/83
8,033,963 B1 * 10/2011 Jones ..... 482/87
8,337,366 B2 12/2012 Jones et al.
8,814,728 B2 * 8/2014 Safran ..... 473/423

* cited by examiner

START
CLEAR MEMORY INITIALIZE COUNTERS, FLAGS
INCREMENT RANDOM NUMBER COUNT
KEY DOWN ?
START KEY ?
REPEAT KEY ?
RECALL KEY ?
READ GAMESWITCH STORE GAME TYPE
SET REPEAT FLAG
SET RECALL FLAG
SET TONE FLAG INITIALIZE COUNTERS
KEYS BUTTON ?
KEY BUTTON ?
END OF GAME ?
STORE SOUND SERIES ?
SET TONEFLAG
EMIT END OF GAME TONE
STORE TONE SERIES
ERROR
YES
NO
A
B
C
901
902
903
904
905
906
907
908
909
910
911
1001
1002
1003
1004
1005
1006
1007

MOBILE, PORTABLE, AND INTERACTIVE EXERCISE APPARATUS

CROSS-REFERENCE TO RELATED APPLICATIONS

This application claims priority to U.S. Provisional Patent Application No. 61/810,759, entitled "Mobile/Portable interactive apparatus," filed on Apr. 11, 2013, which is incorporated herein in its entirety.

STATEMENT OF GOVERNMENTAL INTEREST

None.

BACKGROUND OF THE INVENTION

1. Field of the Invention

The disclosure relates generally to exercise devices, and more particularly to devices that are kicked or punched by the user as a form of exercise.

2. Background Discussion

In contact or combative sports training, striking devices such as punching bags, heavy bags and punching pads are well known in the art. These bags are normally suspended overhead using chains secured to the ceiling or supported by a stand on the ground. Conventional striking bags suspended from the ceiling are difficult and laborious to adjust in height as well as being difficult to transport. Conventional striking bags supported by the ground are bulky to transport because of the added size of the base and are difficult to adjust in height. Additionally, conventional striking bags supported by the ground are often poorly supported and unstable requiring a sparring partner to hold the bag in order to provide additional stability. Conventional heavy bags supported by the ground commonly include a large, bulky base making the apparatus difficult to move about. It is therefore to the effective resolution of some of the aforementioned problems and shortcomings that some of the disclosed embodiments are directed.

A variety of kicking and punching aids currently exist in the art. These aids function primarily to provide a point of impact absorption for kicks and punches. A variety of configurations exist. Some are free standing with the aid of a supporting base. Others, commonly referred to as heavy bags, hang from a support structure. All are made for use in open areas, and are typically large, bulky, and difficult to relocate or transport. Some examples are the Boone U.S. Pat. No. 3,757,306, the Morrison et al U.S. Pat. No. 4,207,087, the D'Alto U.S. Pat. No. 5,437,590, the Allard et al U.S. Pat. No. 5,733,193, the Chen U.S. Pat. No. 5,863,278, the Chen U.S. Pat. No. 6,251,051, the Weber U.S. Pat. No. 6,790,167, the Ghim U.S. Pat. No. 7,278,957, the Sheedy U.S. Pat. No. 7,909,749, and the Jones et al U.S. Pat. No. 8,337,366. In light of such the various shortfalls of such exercise devices therefore, a need exists for a new and improved striking apparatus.

SUMMARY

It is an object of some of the disclosed embodiments to provide a mobile/portable electronic interactive striking apparatus that comprises a body unit, multiple striking surfaces, various vertical adjustment methods, and multiple attachment means, which enables the user to easily change convert the apparatus between the various embodiments, adjust the weight of the striking bag or the height of the striking apparatus.

It is also an object of some of the disclosed embodiments to provide an electronic interactive program/game that controls the interaction between participants, or which can be played against the control unit itself.

It is another object of the disclosed embodiments to provide an interactive program/game that tests the aural and visual memory of a participant against the control unit.

It is a further object of the disclosed embodiments to provide a striking apparatus type interactive program/game device that provides an automatic sequence of events that must be repeated by a participant.

It is yet another object of the disclosed embodiments to provide a microprocessor controlled interactive program/game that controls the progress of an interactive program/game played between two participants.

It is yet another object of the disclosed embodiments to provide a microprocessor controlled interactive program/game that can be programmed to play a variety of interactive program/games.

In accordance with a preferred embodiment of the invention, there is provided a striking apparatus comprising a plurality of impact sensors, each associated with a strike trigger in the form of sound or light, or both. The device utilizes a microprocessor to generate a sequence of lights and sounds, each uniquely associated with one of the impact sensor switches on the keyboard. The microprocessor is programmed to generate a random sequence of sound or lights, or both, which must be repeated by a participant by striking the proper impact sensors. If the participant correctly repeats the sequence, the control unit adds another entry to the sequence and plays the lengthened sequence which must again be repeated by the participant. The process is repeated to provide an ever-lengthening sequence until the participant makes an error or, if desired, until the sequence reaches a predetermined length. The control unit then indicates whether the control unit or the participant has won, and may be programmed to indicate the longest sequence successfully repeated. Also, the sound generation or the light generation may be suppressed to provide an interactive program/game playable in response to sound or light triggered sequences only. Also, controls may be provided for increasing the speed of the interactive program/game either manually or automatically as the interactive program/game progresses.

In an alternative embodiment, the control unit can be used to control the interaction of two participants. In such an embodiment, one of the participants generates a first sequence that must be repeated by the other, who adds a subsequent event to the sequence. As in the case of the above-described embodiment, the control unit keeps track of the longest sequence successfully repeated and declares a winner when one of the participants makes an error. Also, as in the case of the above embodiment, the sequence may take the form of a sound triggered sequence, light sequence or combination of a sound and light sequence.

Yet another embodiment of the invention is a sensor unit for a striking apparatus including an accelerometer for measuring a strike and a signal processor communicatively connected to the accelerometer, for discerning the strike and calculating values relative to a peak acceleration, direction, total work, and total energy for the strike.

Another embodiment of the invention is a method of varying an operation of a striking apparatus to accommodate input of a user of the striking apparatus responsive to direction of the striking apparatus. The method includes setting a maximum duration for the user input, prompting the user input, timing for the maximum duration, detecting if the user input is received, returning to the step of prompting upon receipt of the user input if prior to expiration of the maximum duration, and returning to the step of prompting upon expiration of the maximum duration if the user input is not received.

Some embodiments disclosed herein are portable exercise apparatuses comprising a speed bag assembly. The speed bag assembly further comprises a support arm having a first end and a second end, a speed bag platform connected to the first end of the support arm, a speed bag connected to the speed bag platform, and a speed bag column having a top end and a bottom end. In an embodiment, the second end of the support arm is adjustably connected to the top end of the speed bag column. These embodiments further comprises a striking pad assembly having a striking pad having a top surface, a bottom surface, a non-striking surface, a central bore extending between the top surface and the bottom surface, and a longitudinal indentation extending between the top surface and the bottom surface and centrally along the non-striking surface. The longitudinal indentation is configured to conform against angled walls of a firm structure. In one embodiment the bore comprise an inward extending protrusion. The striking pad assembly further comprises a striking pad column having a top end and a bottom end. In one embodiment, the striking pad column further comprises a plurality of outward extending protrusions. The outward extending protrusions of the striking pad column are configured to engage the inward extending protrusion of the bore of the striking pad. In one embodiment, the top end of the striking pad column can slide into the bottom end of the speed bag column. These embodiments further comprise a support column having a top end, a bottom end, and a plurality of apertures. The top end of the support column is connected to the bottom end of the striking pad column. There is further a base unit having a plurality of legs and a hollow coupler for receiving the bottom end of the support column in a manner as to allow the user to use the combination of the base unit and the support column to adjust the height of the exercise apparatus as desired. The legs of the base unit are configured to optimally press the exercise apparatus against the angled walls of the firm structure (e.g., a wall corner or angled walls of a heavy piece of furniture) as the sole means of stabilization. The hollow coupler comprises an aperture used to connect the base unit to the support column through a selective aperture from the support column's plurality of apertures.

In other embodiments, the portable exercise apparatus further comprises means for converting the striking pad assembly to a heavy striking bag. In yet other embodiments, the portable exercise apparatus further comprises means for converting the portable exercise apparatus to a hand held striking pad.

Some preferred portable exercise apparatuses comprise a speed bag assembly with a support arm, a speed bag platform, a speed bag connected to the speed bag platform, and a speed bag column that can be adjustably connected to the support arm. These embodiments further comprise a striking pad assembly having a striking pad with a striking surface, a non-striking surface, a top surface, a bottom surface, a central bore extending between the top surface and the bottom surface, and a longitudinal indentation extending between the top surface and the bottom surface and centrally along the non-striking surface. The longitudinal indentation is designed to flexibly conform against angled walls of a firm structure. In one embodiment, the central bore of the striking pad comprises an inward extending protrusion. The embodiments further comprise a striking pad column. In one embodiment, the striking pad column has several outward extending protrusions. The outward extending protrusions of the striking pad column are configured to engage the inward extending protrusion of the bore of the striking pad. In one embodiment, the top end of the striking pad column slides into the bottom end of the speed bag column whereto it is secures. These preferred embodiment also comprise an interactive program unit, which in turn comprises a plurality of impact sensors operatively connected to the striking surface of the striking pad, a plurality of strike triggers each of which uniquely associated with a respective impact sensor from the plurality of impact sensors, a memory for storing a plurality of interactive exercise programs, a control unit having a plurality of switches used to select an interactive exercise program from the plurality of interactive exercise programs, and a microprocessor operatively connected between the impact sensors, the strike triggers, and the control unit to facilitate the selected interactive exercise program. These embodiments further comprise a support column having a top end, a bottom end, and a plurality of apertures. The top end of the support column is connected to the bottom end of the striking pad column. These preferred embodiments also comprise a base unit having a plurality of legs and a hollow coupler for receiving the bottom end of the support column in a manner as to allow the user to use the combination of the base unit and the support column to adjust the height of the exercise apparatus as desired. The legs of the base unit are configured to optimally press the exercise apparatus against the angled walls of the firm structure (e.g., a wall corner or angled walls of a heavy piece of furniture) as the sole means of stabilization. The hollow coupler comprises an aperture used to connect the base unit to the support column through a selective aperture from the support column's plurality of apertures.

Other preferred portable exercise apparatuses comprise a speed bag assembly having a support arm, a speed bag platform, a speed bag connected to the speed bag platform, and a speed bag column that can be adjustably connected to the support arm. These embodiments further comprise a striking pad assembly having a striking pad with a striking surface, a non-striking surface, a top surface, a bottom surface, a central bore extending between the top surface and the bottom surface, and a longitudinal indentation extending between the top surface and the bottom surface and centrally along the non-striking surface. The longitudinal indentation is designed to flexibly conform against angled walls of a firm structure. In one embodiment, the central bore of the striking pad comprises an inward extending protrusion. The embodiments further comprise a striking pad column. In one embodiment, the striking pad column has several outward extending protrusions. The outward extending protrusions of the striking pad column are configured to engage the inward extending protrusion of the bore of the striking pad. In one embodiment, the top end of the striking pad column slides into the bottom end of the speed bag column whereto it is secures. Such preferred embodiments further comprise an interactive program unit, which in turn comprises a first set of impact sensors operatively connected to the striking surface of the striking pad, a second set of impact sensors operatively connected to the speed bag, a first set of strike triggers each of which uniquely associated with a respective impact sensor from the first set of impact sensors, a second set of strike triggers each of which uniquely associated with a respective impact sensor from the second set of impact sensors, a memory for storing a plurality of interactive exercise programs, a control unit having a plurality of switches used to select an interactive exercise program from the plurality of interactive exercise programs, a microprocessor operatively connected between the first and second sets of impact sensors, the first and second sets of strike triggers, and the control unit to facilitate the selected interactive exercise program. These embodiments further comprise a support column and a base unit having a plurality of legs and a hollow coupler for receiving the bottom end of the support column in a manner as to allow the user to use the combination of the base unit and the support column to adjust the height of the exercise apparatus as desired. The legs of the base unit are configured to optimally press the exercise apparatus against the angled walls of the firm structure (e.g., a wall corner or angled walls of a heavy piece of furniture) as the sole means of stabilization. The hollow coupler comprises an aperture used to connect the base unit to the support column through a selective aperture from the support column's plurality of apertures.

In yet other embodiments, the interactive program unit further comprises a speaker connected to the microprocessor. Each strike trigger from the plurality of strike triggers is a distinct audio cue uniquely associated with the respective impact sensor. In these embodiments, the microprocessor is configured to receive a signal from the control unit that identifies the selected interactive exercise program from the plurality of interactive exercise programs stored on the memory. In these embodiments, the microprocessor is further configured to utilize the speaker to sound the distinct audio cues in a predetermined sequence according to the selected interactive exercise program. In other embodiments, the interactive program unit further comprises a multi-color light emitting means connected to the microprocessor, and wherein each strike trigger from the plurality of strike triggers is a distinct visual cue uniquely associated with the respective impact sensor. In these embodiments, the microprocessor is configured to receive a signal from the control unit that identifies the selected interactive exercise program from the plurality of interactive exercise programs stored on the memory, and is further configured to utilize the multi-color light emitting means to emit the distinct visual cues in a predetermined sequence according to the selected interactive exercise program. In yet other embodiments, the interactive program unit further comprises a speaker connected to the microprocessor and a multi-color light emitting means connected to the microprocessor. In these embodiments, each strike trigger from the plurality of strike triggers is a distinct audio cue uniquely associated with the respective impact sensor and/or a distinct visual cue uniquely associated with the respective impact sensor. In these embodiments, the microprocessor is configured to receive a signal from the control unit that identifies the selected interactive exercise program from the plurality of interactive exercise programs stored on the memory, and to utilize the speaker and the multi-color light emitting means to emit a predetermined combination of the distinct audio cues and/or distinct visual cues in a predetermined sequence according to the selected interactive exercise program.

As discussed in more detail below in the context of the disclosed structures, some embodiments further comprise means for selecting an error criteria for the selected interactive exercise program and means for determining whether the error criteria has been met. In such embodiments, the microprocessor is further configured to utilize the speaker and/or the multi-color light emitting device to indicate that the error criteria has been met. Other embodiment further comprise means for measuring punch strength, means for measuring response time, and means for communicating the measured punch strength and response time to the user.

Many other features and embodiments disclosed herein will be apparent from the accompanying drawings and from the following detailed description. One of ordinary skill in the art would recognize that the disclosed embodiments, including the embodiments illustrated in the drawings, are exemplary only and as such do not operate to limit the scope of the disclosed invention.

DRAWINGS

The above-mentioned features and objects of the present disclosure will become more apparent with reference to the following description taken in conjunction with the accompanying drawings wherein like reference numerals denote like elements and in which:

FIG. 1 is a perspective view of a striking apparatus, according to certain embodiments of the invention.

FIGS. 2*a* and 2*b* are exploded views of a striking apparatus constructed in accordance with the disclosed embodiments accompanied by FIG. 2*c* a perspective view of a base in accordance with the disclosed embodiments.

DETAILED DESCRIPTION

Figure 1:
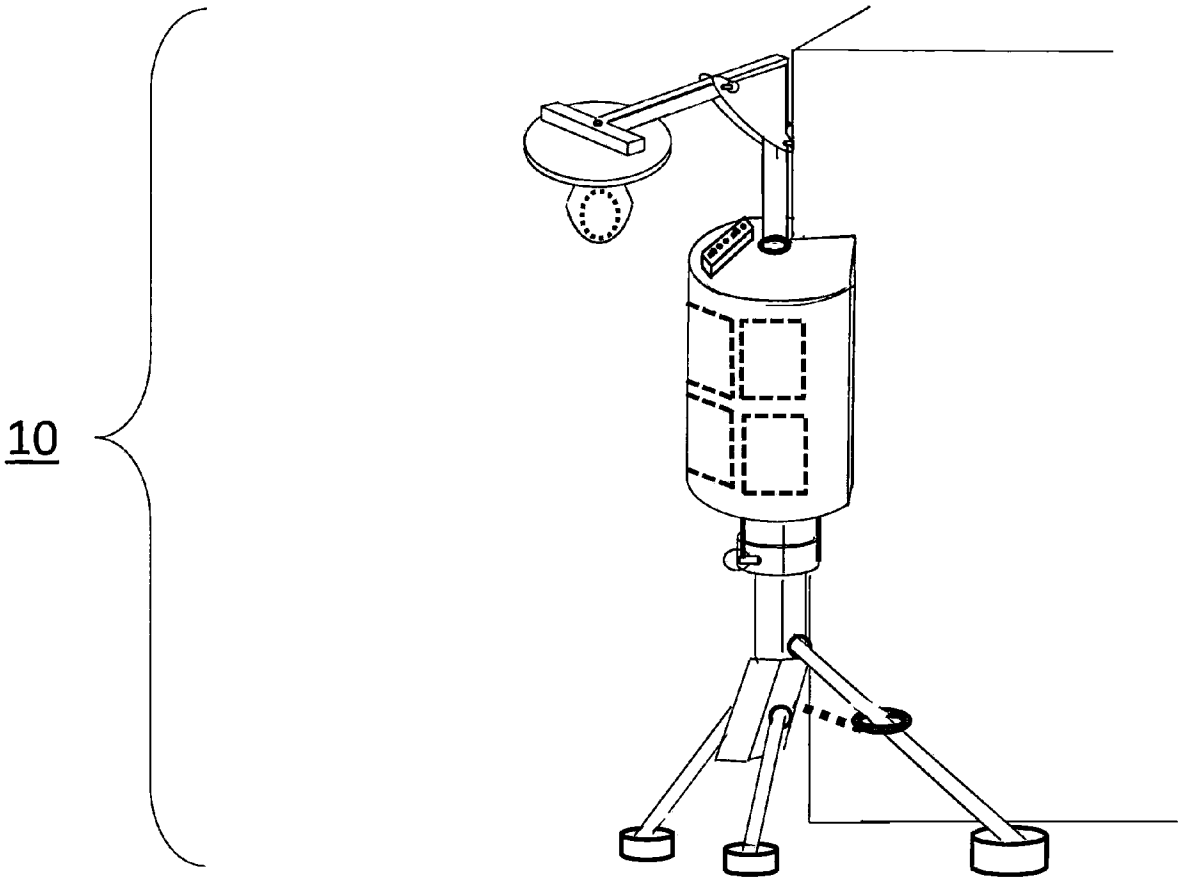
Figure 2A:
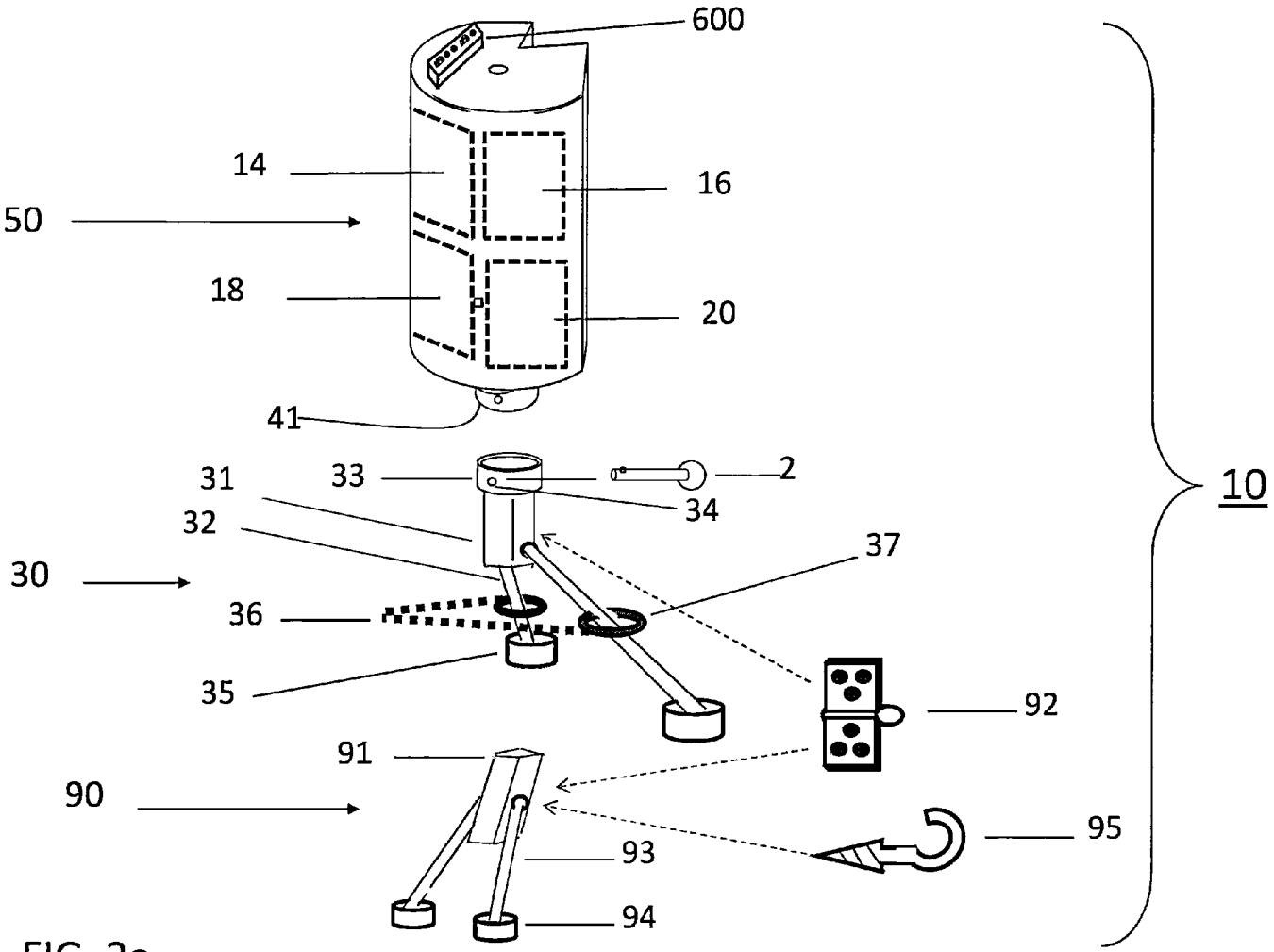
Figure 2B:
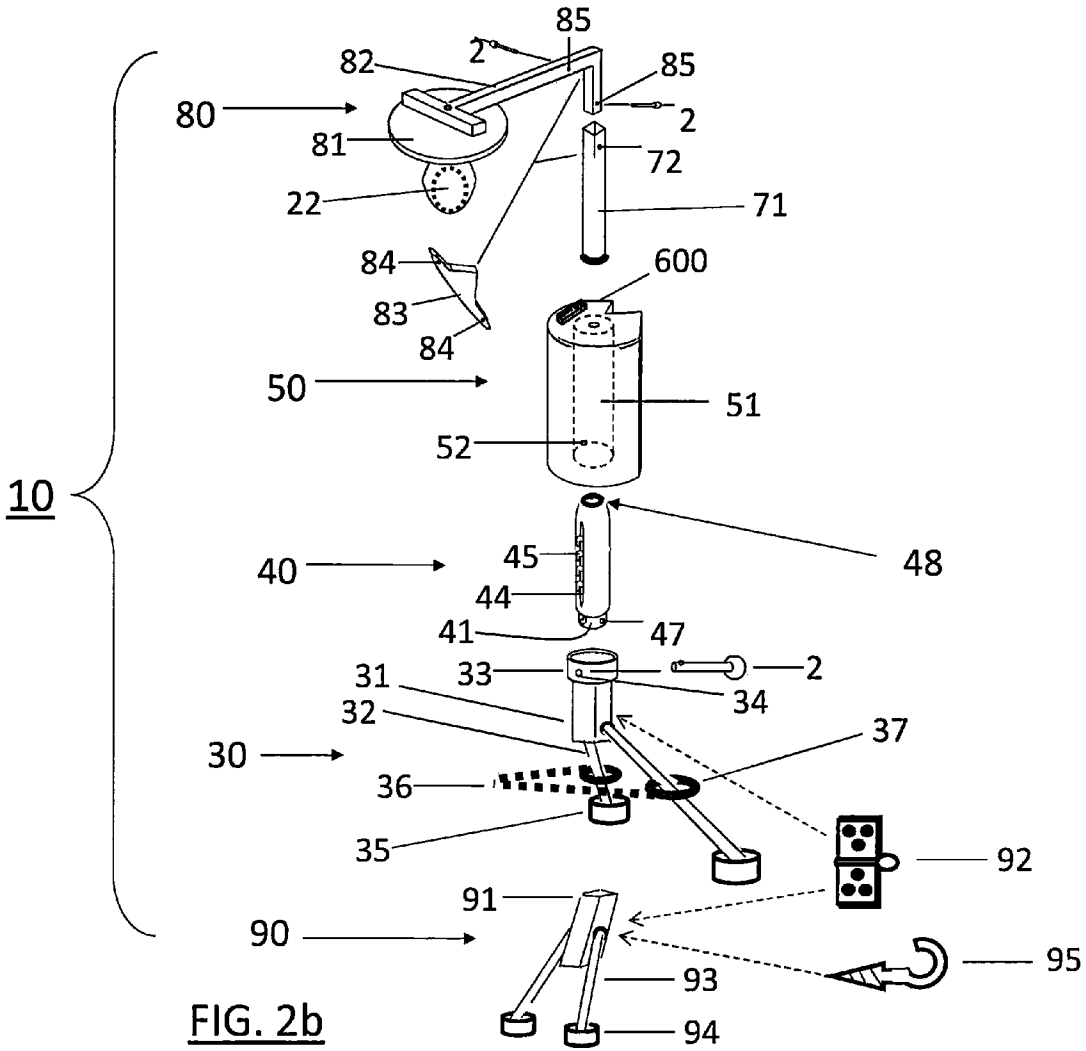

FIG. 1, in conjunction with FIG. 2*a* & FIG. 2*b*, illustrates an embodiment of the disclosed interactive striking apparatus 10. The illustrated interactive striking apparatus 10 includes a striking pad 50 and speed bag device 80 that contains impact sensors 14, 16, 18, 20 and 22 that are operated by a participant playing the interactive program/game. Each of the impact sensors 14, 16, 18, 20 and 22 is associated with a particular sound that is made when a respective one of the impact sensors is struck. In addition, one of a plurality of indicator lights may be illuminated upon striking of each of the impact sensors. In the embodiment illustrated in FIG. 2*a*, the indicator lights are located under the respective impact sensors and serve to illuminate the impact sensors as they are struck. In the embodiment illustrated in FIG. 2*b*, The illustrated speed bag device 80 includes a speed bag platform 81 secured to the upper end of a support arm 82 whose lower end fits into the speed bag column 71. In one embodiment, the support arm 82 is adjustably connected to the speed bag column 71 and can be further secured with a support brace 83 via apertures 72, 84 and 85.

A support unit 30 includes a coupler 33 and column 31 to be secured vertically on top of the base 90 via hinge 92. The coupler 33 includes an aperture 34 formed therein for threading a fastener or a pin 2, such as a column 31 provided on the lower portion thereof, which includes legs 32 attached therein secured at their lower end to weighted feet/pads 35. The support unit 30 formed such that it works in conjunction with the base 90 to create pull on the striking apparatus' 10 center of gravity backwards causing its load to press into any support structure. The base 90 includes a column 91, which includes legs 93 attached therein secured at their lower end to weighted feet/pads 94.

A column 40 is to be secured vertically on top of the support unit 30 via a coupler 33, such as by a stud 41 provided on the lower portion of the column 40. The column 40 has a top coupler portion 48 used to secure the column 40 to the speed bag column 71. The stud 41 includes an aperture 47 formed therein for threading a fastener or a pin 2. The column 40 includes one or more longitudinal channels 44 formed therein and having one or more lock slots 45 communicating with the respective channels 44. A striking pad 50 is formed to include angled walls 54 which allow it to conform to inner and outer angled wall corners or any other firm structure, and includes a bore 51 formed therein for receiving the column 40 and includes one or more projections 52 extended inward of the bore 51 thereof for engaging into the channels 44 and/or the lock slots 45 of the column 40 and for setting the striking pad 50 to various heights.

Figure 2C:
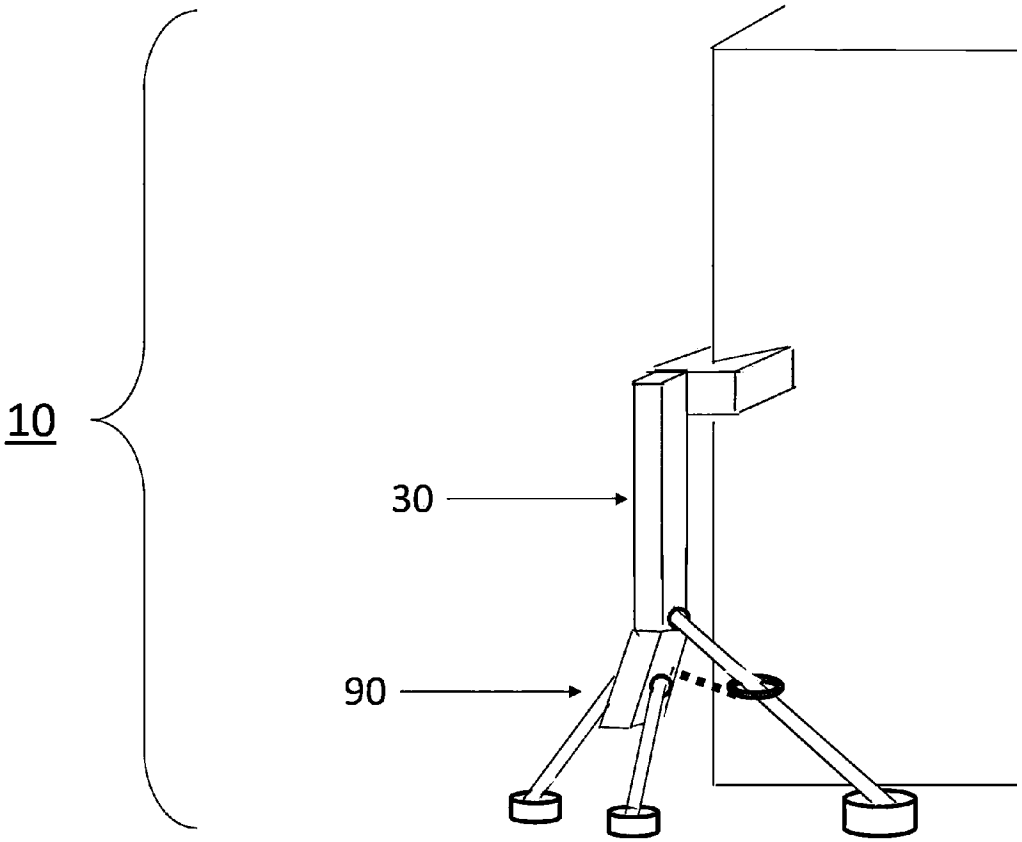

FIG. 2*c* illustrates an embodiment in accordance with some of the disclosed embodiments comprising support unit 30 and a base 90 which aide in stabilizing and locking the apparatus into position with the aid of attachment hook 95, tension chord 96, and tension chord rings 37.

Figure 3:
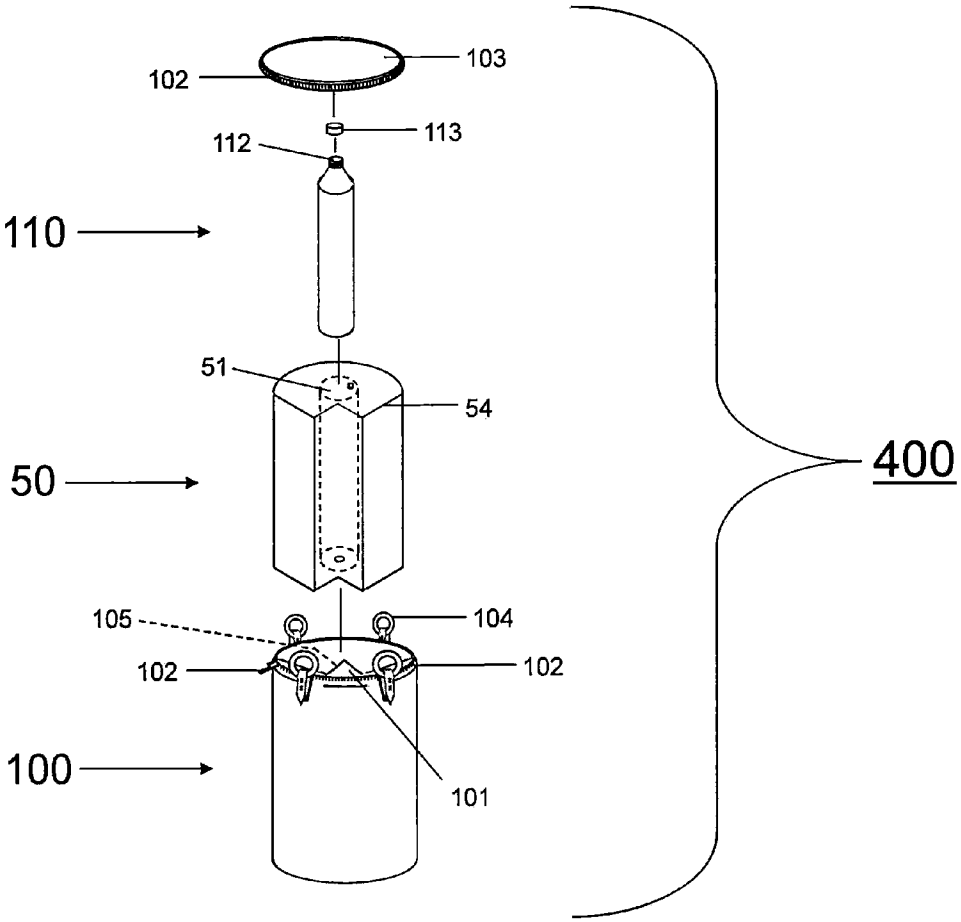
FIG. 3 is an exploded view of striking apparatus, constructed in accordance with the disclosed embodiments, in which several of the attachment means allowing it to be used as a heavy bag.
Figure 4:
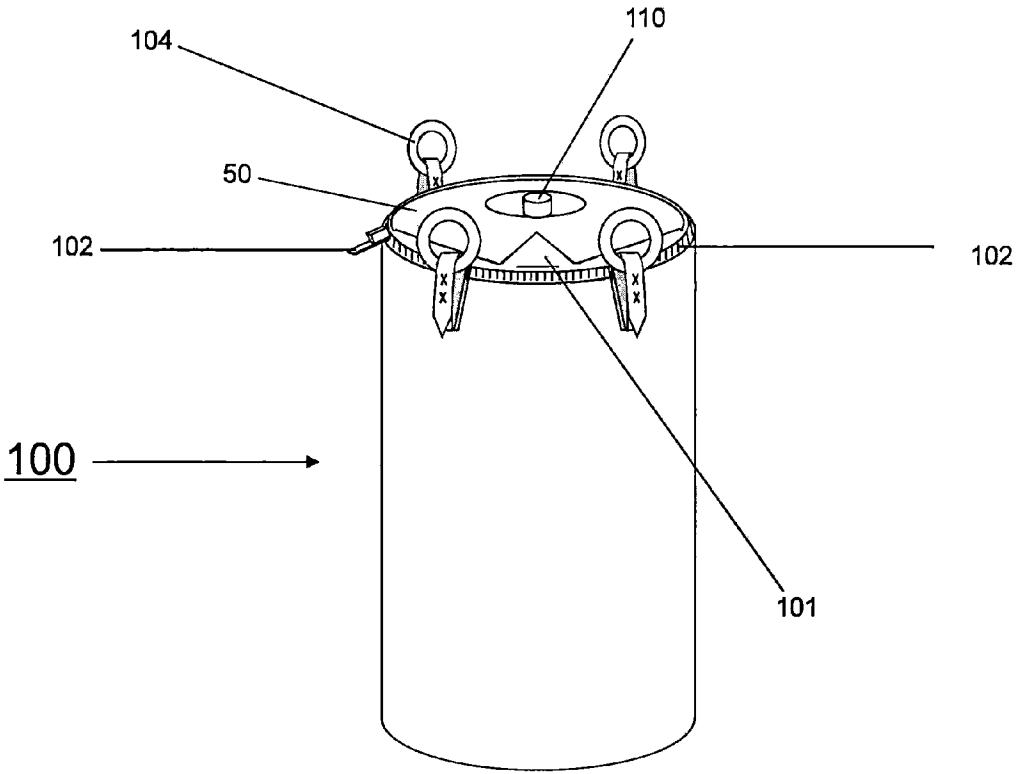
FIG. 4 is a perspective view of FIG. 3.

Referring to FIG. 3 & FIG. 4, a striking apparatus in accordance with some of the disclosed embodiments comprises a heavy bag conversion application 400, which includes a heavy bag 100 including a padded inner liner 101 that is formed such that it couples with the angles 54 of the striking pad 50 to form the completed circular striking surface that is indicative of a conventional hanging heavy "punching" bag. The heavy bag 100 includes hanging attachments 104 for hanging the bag via suitable means, and a zipper 102 for securing all necessary components within the heavy bag 100 via its top enclosure 103.

A striking pad 50 is inserted into the heavy bag 100 with the open end of its bore 51 facing upward. The angles 54 of the striking pad 50 are then aligned with the angles 105 of the inner liner 101 such that the angled walls 105 of the inner liner 101 are aligned with the angled walls 54 of the striking pad 50 to form a completed circle.

A bag 110 is included for adjusting the weight of the heavy bag assembly 110 through the receiving of fluids, such as water, any suitable liquid, or other particulate materials, such as sand, gravel, coated or uncoated metallic shot and the like. The fluids are received through the mouth 112 of the bag 110. A cap 113 is detachably secured onto the mouth 112 of the bag 110 for confining the fluids within the bag 110. The bag 110 should be empty when inserted into the bore 51 of the striking pad 50, after which it can be filled to the desired weight with the desired suitable material.

Figure 5:
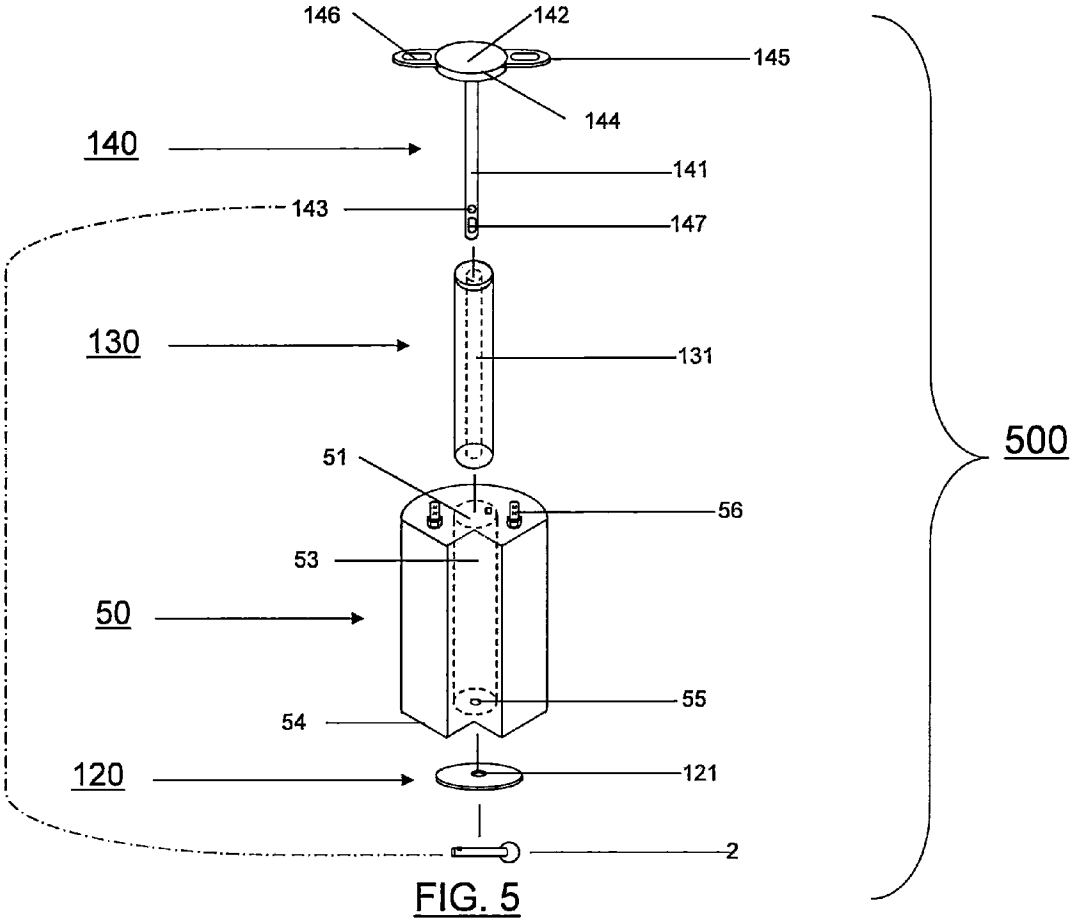
FIG. 5 is an exploded view of a striking apparatus constructed in accordance with the disclosed embodiments, in which it is prepared for use as a hand-held training aid.
Figure 6:
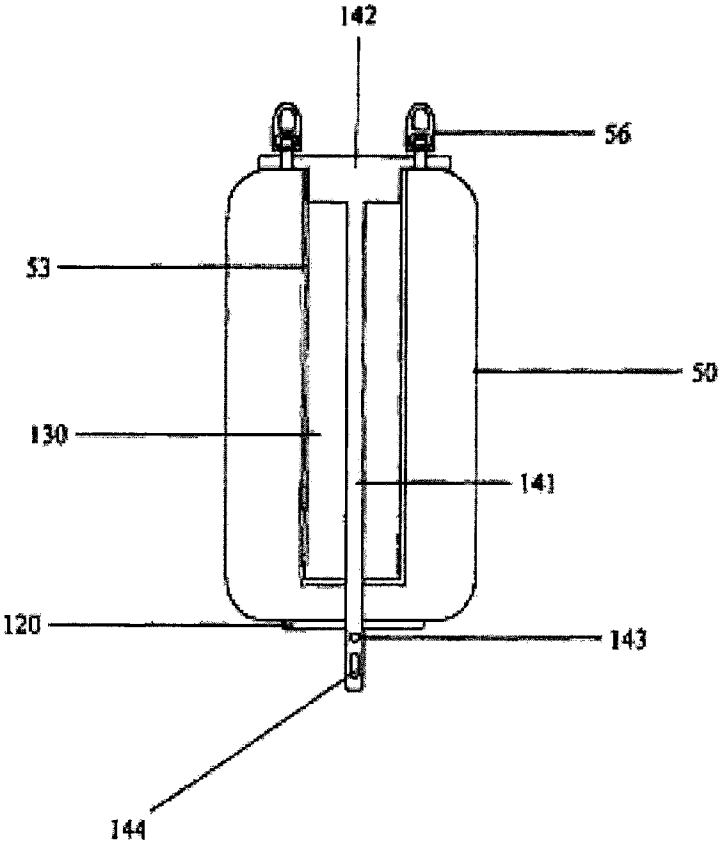
FIG. 6 is a side view of FIG. 5.
Figure 7:
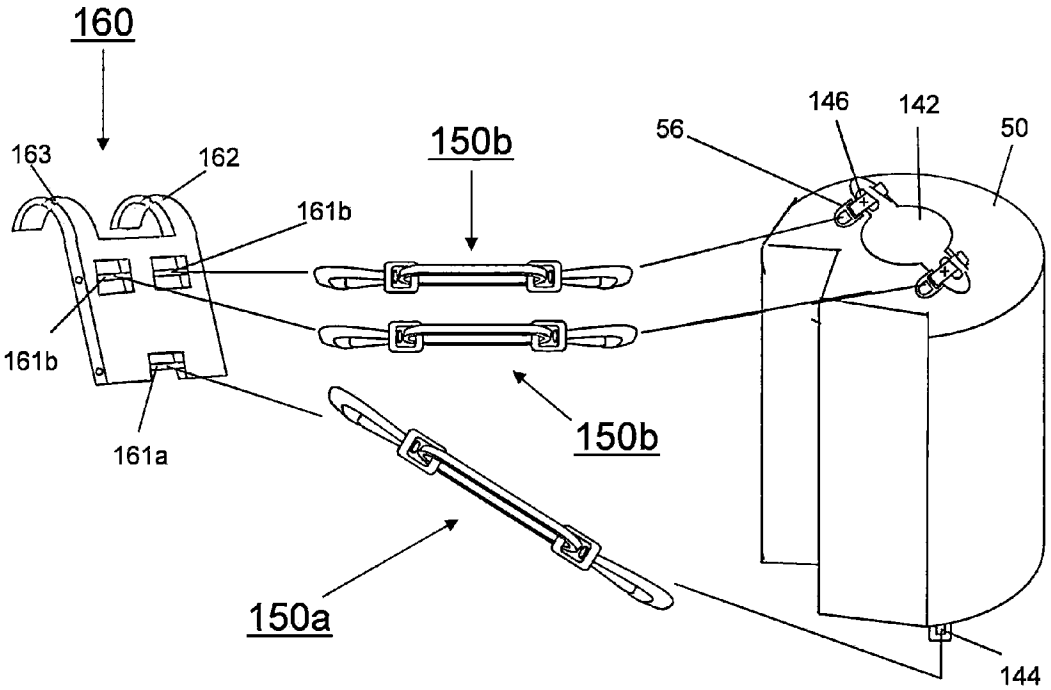
FIG. 7 is a sectional view of FIG. 5.

Referring to FIG. 5 & FIG. 6, in conjunction with FIG. 7, a striking apparatus in accordance with some of the disclosed embodiments comprises a hand-held application 500, which includes a base support 120 with a hole at its center formed therein for threading the shaft 141 of the anchoring post 140. A striking pad 50 is used with the open end of its bore 51 facing upward to receive the center-cushion 130, the hole 55 of the striking pad 50 is formed therein for threading the shaft 141 of the anchoring post 140 as well as to allow air flow. A center-cushion 130 is preferably made of light weight spongy or rubber materials preferably stiffer and denser than all materials used to make the striking pad 50 for striking and support purposes, and is formed to include a bore 131 at its center which is formed therein for threading the shaft 141 of the anchoring post 140 and to align with the hole 55 of the striking pad 50, the center-cushion is shorter in length than the bore 51 of the striking pad 50 but the diameter of the center-cushion 130 is formed such that it completely fills the bore 51 of the striking pad 50. The center-cushion 130 is seated inside of the barrel 53 of the striking pad 50 via its bore 51. An anchoring post 140 includes a top 142 with two equally distanced opposing peripheral protrusions 145, wherein each protrusion 145 contains an aperture 146 formed therein for threading the links 56 of the striking pad 50. The length of the bottom half 144 of the top 142 fills in the remaining length in the barrel 53 that was left unfilled by the center-cushion 130 that is seated inside of the barrel 53. The diameter of the bottom half 144 of the top 142 is formed such that it completely fills the bore 51 of the striking pad 50. The shaft 141 extends downward from the center of the bottom half 144 and contains two apertures near its end. The aperture 143 is formed therein for threading a fastener or a pin 2, and aperture 147 is formed therein for threading a fastener or a clasp 151. The shaft 141 of the anchoring post 140 is to be threaded through the bore 131 of the center-cushion 130 and the hole 55 of the striking pad 50 such that bottom half 144 of the top 142 is seated firmly atop of the center-cushion 130 within the bore 51 of the barrel 53 of the striking pad 50. The links 56 are to be threaded through their respective aperture 146 of the protrusion 145 of the anchoring post 140 which will allow the top 142 of the anchoring post 140 to fit flush against all related parts of the handheld application 500. As illustrated, the support base 120 can be connected by threading the hole 121 of the support base 120 with the exposed end of the shaft 141 of the anchoring post 140 such that a fastener or pin 2 can be inserted through the aperture 143 of the shaft 141 thus locking the support base 120 to the striking pad 50 and securing the anchoring post 140 in place.

As illustrated in FIG. 7, adjustable straps 150*a* and 150*b*, and a body brace 160 are used to secure the handheld application 500 to the user, which may be the trainer as used in this paragraph. Adjustable straps 150*b* are secured to their respective link 56 of the striking pad 50 of the hand-held application 500 via a swiveling clasp 151 located at either end of each adjustable strap 150*b*. As illustrated, adjustable strap 150*a* is secured to aperture 147 of the anchoring post 140 of the handheld application 500. Each remaining unsecured swiveling clasp 151 of the adjustable straps 150*b* can now be secured to its respective anchoring point 161*b* of the body brace 160. The unsecured end of adjustable strap 150*a* can be secured via its swiveling clasp 151 to anchoring point 161*a* of the body brace 160. The body brace 160 may be worn by the user via its shoulder supports 162 and 163. The shoulder support 162 fits over the left shoulder of the user while shoulder support 163 fits over the user's right shoulder. The body brace 160 will rest against the front of the users and on both shoulders, which helps to balance the weight (although extremely light) of the handheld application 500 evenly throughout the body of the user, such that the user may move freely about with the handheld application, using it as a moving target or opposing training aid from which the user will be able to see over the top of to observe and critique the technique of the person striking the handheld application 500.

Figure 8:
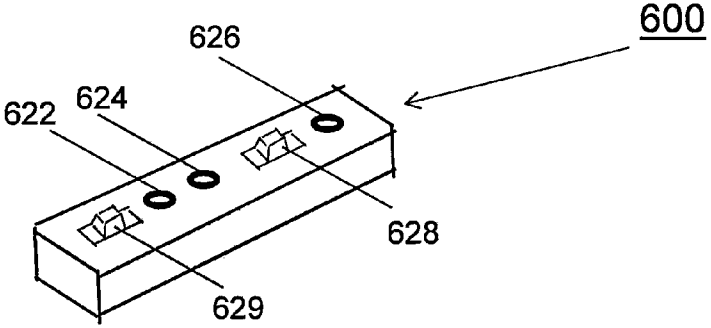
FIG. 8 is a perspective view of FIG. 5 and all necessary attachments.

FIG. 8 illustrates an embodiment of the interactive program/game control unit 600. The interactive program/game control unit 600 includes control switches 622, 624 and 626. In one embodiment, the control switches 622, 624 and 626 permit the recall of the last played sequence, the longest sound sequence, or control the start of a new interactive program/game, respectively. In one embodiment, a slide switch 628 permits the user to select one of several interactive program/games playable by the unit, and a switch 629 selects the length of the sequence that must be achieved for the participant to be declared a winner.

Several interactive program/games may be played by the control unit 600 illustrated in FIG. 8. In one embodiment, such interactive program/games are selected by appropriately positioning the slide switch 628. The microprocessor 730, which is described in more detail below, may be programmed to play various program/games.

In one embodiment, upon selection of the start of interactive program/game switch 626, the microprocessor will cause one of multiple notes contained in its memory to be sounded. In addition, one of the multiple indicator lights associated with a particular one of the impact sensors 14, 16, 18, 20 and 22 will be illuminated. The participating player must now depress the one of the impact sensors 14, 16, 18, 20 and 22 associated with the sound sounded, as indicated by the illumination of its associated lamp. In this embodiment, if the participant strikes the correct one of the impact sensors 14, 16, 18, 20 and 22, the machine repeats the previous sound and adds a new sound (and associated light) to the sequence. So long as the participant strikes the appropriate impact sensor, the machine continues to repeat the previous sequence each time adding one more sound to the sequence. At the first occurrence of an erroneous impact sensors entry, the microprocessor causes a distinctive error sound. This concludes the interactive program/game sequence. In another embodiment, the microprocessor may be programmed to generate a second distinctive "win" signal when the sequence reaches a predetermined length. For example, the length of such a sequence may be selected to be eight, fourteen or twenty sounds by appropriately positioning the switch 629. Finally, the control unit 600 may be programmed to increase the speed of the sequence as the interactive program/game is played to make the interactive program/game more challenging. In some embodiments, after the conclusion of the interactive program/game sequence, the participant has the option of starting a new interactive program/game by depressing the push-button switch 626, or he can review the previously keyed-in sound sequence by pushing the last interactive program/game review pushbutton 622. Upon such a command, the microprocessor will automatically sound out the entire sequence of sounds that had been keyed in up to the point at which the keying error was made. The longest sequence played to date can be reviewed by depressing the push-button switch 624.

In another embodiment, the selected interactive game involves two participants who take turns alternately repeating the previous sequence and adding another sound to the sequence. In this embodiment, the control unit 600 is programmed to keep track of the last sequence, and to sound the error signal whenever one of the participants makes an error. The longest sound sequence played by the participants during any continuous series of interactive program/games may be stored, and the push-button switch 624 may be used to recall this sequence. In this manner, it is possible for the winner of an interactive program/game to compare his performance with the longest sound sequence in the memory.

In yet another embodiment, the interactive program/game involves a participant that must respond within a predetermined time interval, for example, before the sound ends, or before its associated light extinguishes. If the player reacts too slowly, or makes an error, the interactive program/game ends.

In another embodiment, the control unit 600 is programmed to remember not only the sequence of impact sensor entries, but also to remember the length of time that each impact sensor is struck, and the time interval between such occurrences. Thus, the control unit 600 can be programmed to play multiple sounds. If these multiple sounds are properly selected to correspond to the sounds formed in a bugle, then most familiar bugle calls could be keyed in the machine.

In yet another embodiment, the interactive program/game is designed to be played by more than one player. For example, two players may each be assigned two impact sensors, or multiple players may each be assigned a single impact sensor. The interactive program/game may be played in a manner similar to that of Interactive program/game 1, with the machine generating an ever-lengthening sequence of sounds which must be repeated by the players, with each player being responsible for repeating his assigned sound or sounds as they occur in the sequence. In this embodiment, whenever a player responsible for a sound responds incorrectly by, for example, depressing the wrong impact sensors or not responding at all, that sound is taken out of the sequence and play continues among the remaining players. Also, the push button assigned to the participant making the error is caused to blink to indicate which player has made the error. The machine then continues building ever-lengthening sequences based on the remaining sounds. When another error occurs, the player responsible for that sound is out, and the interactive program/game continues with sequences containing only the remaining sounds until only one player is left.

The interactive program/games embodied in the above embodiments have been given by way of example only. One of ordinary skill in the art would recognize that the number of possible interactive program/games is limited only by the capability of the microprocessor within the device and the ingenuity of the programmer.

Figure 9:
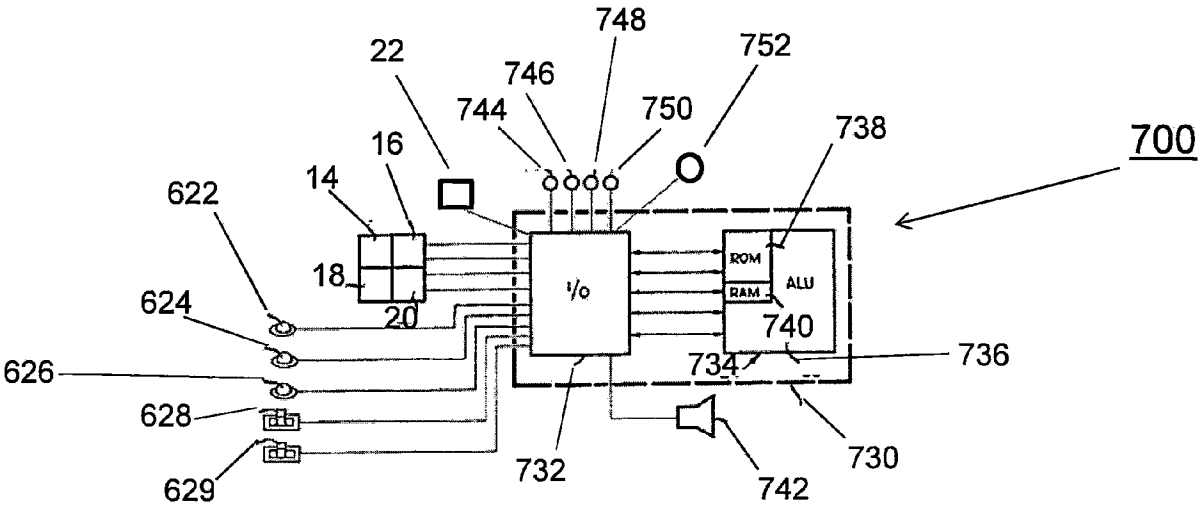
FIG. 9 is a block diagram of the electrical components of an interactive program/game according to the invention.

Referring now to FIG. 9, the device 600 utilizes a microprocessor 730 having an input/output section 732 connecting the manually operable switches 14, 16, 18, 20, 22 622, 624, 626, 628 and 629 to a computing device 734 having an arithmetic logic unit 736, a read-only memory 738, and a random-access memory 740. The arithmetic logic unit processes the inputs received from the various input devices in accordance with the interactive program/game selected from the read-only memory 738 by the selector switch 628 and serves to operate a loud speaker 742 and multiple light indicators 744, 746, 748, 750 and 752, each associated with a respective one of the impact sensors 14, 16, 18, 20 and 22 in accordance with the rules of the interactive program/game selected. Thus, when one of the interactive program/games stored in the read-only memory 738 is selected by the switch 628, the arithmetic logic unit 736 operates on the inputs from the impact sensors 14, 16, 18, 20 and 22 to perform the necessary arithmetic logic steps and to store the necessary data, such as the length of the last sequence into the random-access memory 740. The arithmetic logic unit 736 also serves to provide the necessary responses to the participant by appropriately lighting up the lights 744, 746, 748, 750 and 752, and sounding the appropriate tone or error signal through the loud speaker 742.

Figure 10:
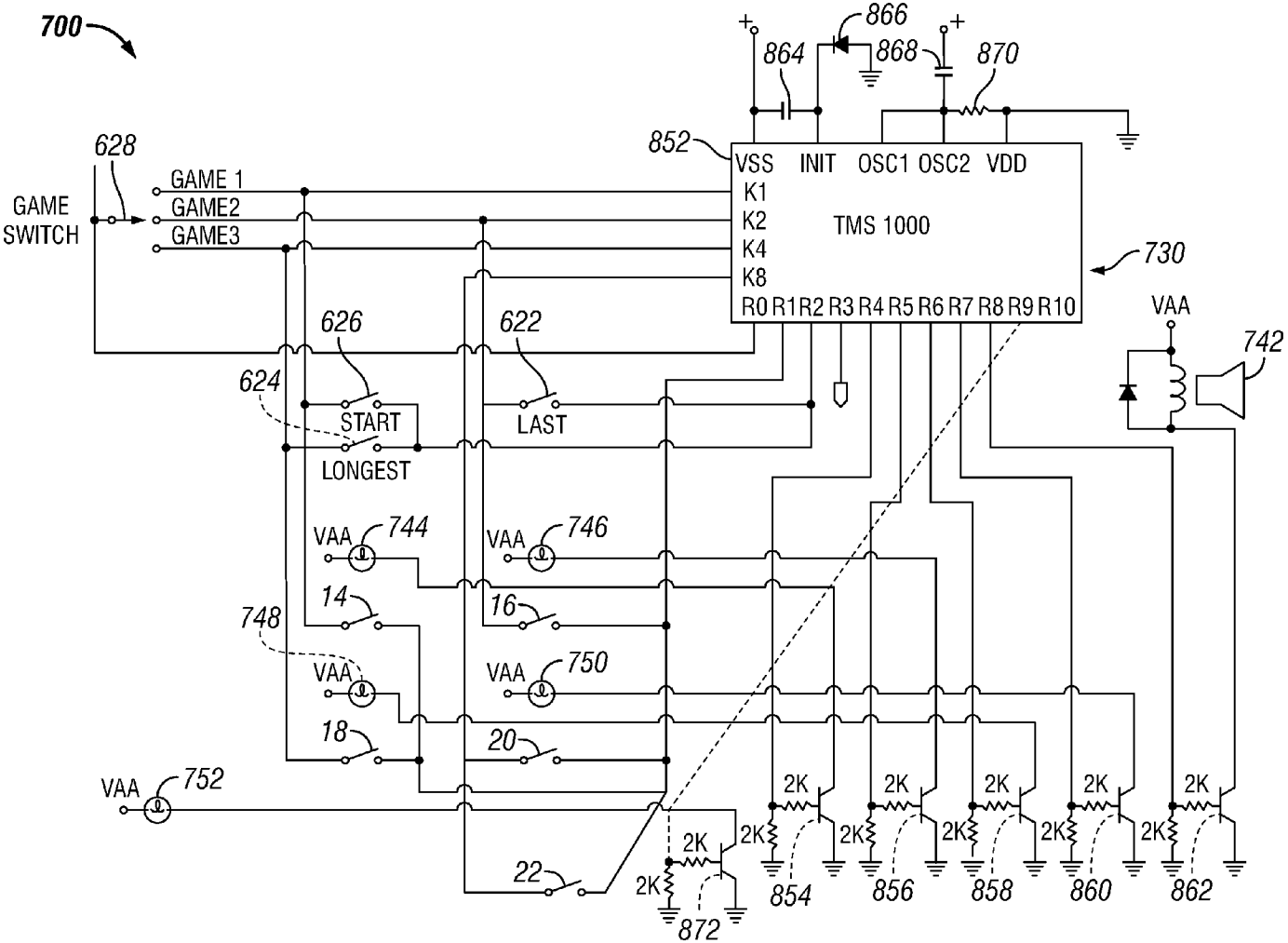
FIG. 10 is a detailed schematic diagram of the electronic circuitry of a interactive program/game according to the disclosed embodiments.

As illustrated in the embodiment of FIG. 10, the device 600 can be implemented utilizing a single chip, large scale integrated circuit microprocessor 852 as the main computing device. In one embodiment, the microprocessor 730 is A TMS1000 single chip microprocessor manufactured by TEXAS INSTRUMENTS INC., which contains the input/output circuitry 732 and the computing device 734 illustrated in FIG. 9. Driver transistors 854, 856, 858, 860 and 862, serving as part of the input/output circuitry 732, are driven by outputs of the microprocessor 852, and serve to drive the lights 744, 746, 748, 750 and 752 and the loud speaker 742. A time delay circuit comprising a capacitor 864 and a diode 866 serve to reset and initiate the operation of the microprocessor each time the power is turned on. A timing circuit comprising a capacitor 868 and a resistor 870 controls the operation of the internal clock of the microprocessor 852.

The microprocessor 852 monitors the state of the impact sensor keys 14, 16, 18, 20 and 22, the control switches 622, 624 and 626 and the interactive program/game selector switch by sequentially energizing its outputs R0-R600 while monitoring its inputs K1, K2, K4 and K8. Thus, when the output R0 is energized, the device can determine the position of the switch 628 by determining which of its inputs K1, K2 or K4 is energized. Similarly, the microprocessor R1 can determine which of the impact sensor keys 14, 16, 18, 20 and 22 is energized by monitoring the multiple inputs K1, K2, K4 and K8 during the time that the output R1 is energized. In a similar manner, the device monitors the inputs K1, K2 and K4 during the time that the output R2 is energized to determine which, if any, of the switches 622, 624 and 626 is energized. The outputs R4-R8 are utilized to drive the driving transistors 854, 856, 858, 860 and 862 which, in turn, drive the indicator lights 744, 746, 748, 750 and 752 and the loud speaker 742.

The microprocessor 852 is readily programmed in a manner described in the TMS 1000 series data manual published in December 1975 by TEXAS INSTRUMENTS, INC., the relevant microprocessor programming sections of which are incorporated herein in their entirety entirety, to perform the functions necessary to play the desired interactive program/games. Flow charts illustrating the programming of the microprocessor are illustrated in FIGS. 11-13.

Figures 11, 12:
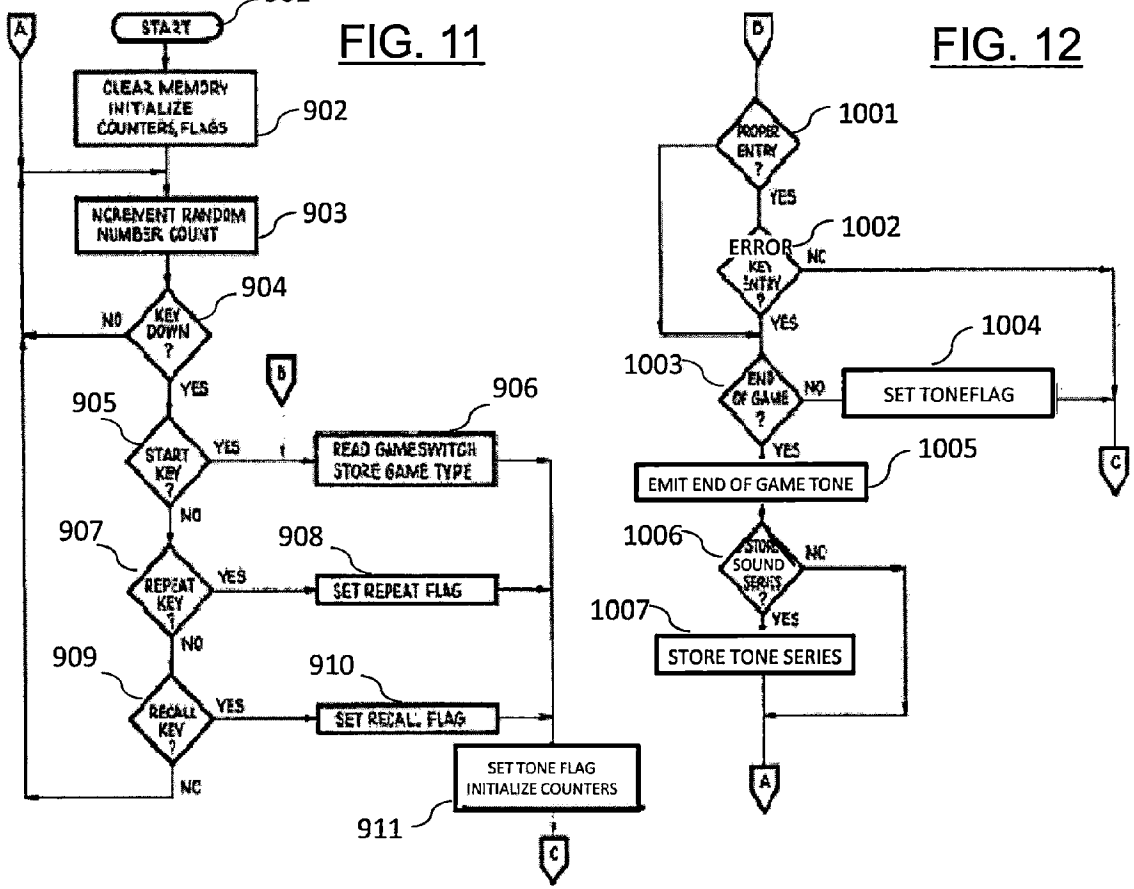
FIGS. 11-13 are logical flow charts illustrating the functions performed by the microprocessor controlling the operation of a interactive program/game according to the invention.

As illustrated in FIG. 11, in step 901 the start switch 626 is depressed, in step 902 the memory of the microprocessor 852 is cleared and in step 903 the random number count of microprocessor 852 is incremented (FIG. 11). A determination is made whether any of the impact sensor keys 14, 16, 18, 20 or 22 are struck. In step 904 if not, the random number count is continuously incremented. If one of the impact sensors is struck, a determination is made to determine which of the impact sensor keys has been struck. In step 905 if the start key has been depressed, in step 906 the microprocessor 852 reads the position of the interactive program/game selecting switch 628 and selects the stored interactive program/game corresponding to that position. If the key in step 907 requesting the repeat of the last sequence or in step 909 the key requesting the recall of the longest sequence is depressed, the appropriate repeat flag in step 908 or recall flag in step 910 is set. Also, in step 911 the tone flag is set and the counters are initialized.

Figure 13:
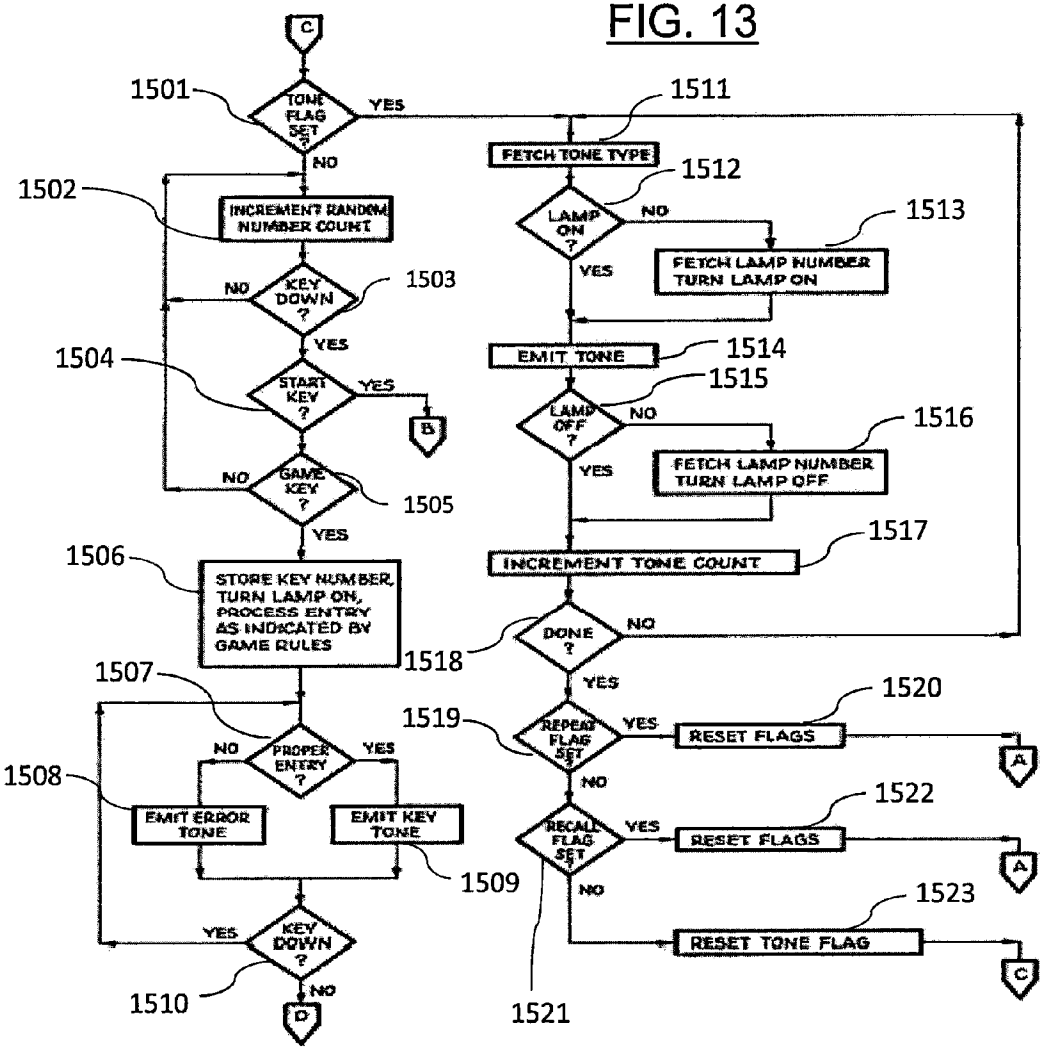

As illustrated in FIG. 13, when the start switch 626 is depressed, causing the appropriate interactive program/game to be stored, if in step 1501 the tone flag is set, the setting of the tone flag causes in step 1511*a* particular tone type to be fetched (FIG. 13). A determination is then made as to whether the lamp associated with that tone type is on. In step 1512 if the lamp is on, the tone is emitted, otherwise in step 1513 the lamp is first turned on and in step 1514 the tone is emitted. After the tone has been emitted, in step 1515 or 1516 the lamp is turned off and in step 1517 the tone count is incremented. In step 1518 the done status is verified. If in step 1519 the repeat flag is not set, which is normally the case during the time that an interactive program/game is being played, in step 1520 the repeat flag is reset or if in step 1521 recall flag is not set, which is normally the case during the time that an interactive program/game is being played, in step 1522 the recall flag is reset. In step 1523 the tone flag is reset, after which if in step 1501 the tone flag is not set, in step 1502 the counters is initialized. If the entry is proper and the interactive program/game is not otherwise terminated, the tone flag is again set and the next tone is sequence generated until an error occurs.

Another determination is made in step 1503 to determine whether an impact sensor key is struck (left branch of FIG. 13). In step 1504 the start key is triggered. In step 1505 the game key status is checked. In step 1506 the key selection is processed as indicated by game rules. Based on this determination, in step 1507 either an error tone in step 1508 or a tone in step 1509 corresponding to the impact sensor key is sounded. After which in step 1510 the key down status is checked. If the entry is proper and the interactive program/game is not otherwise terminated, the tone flag is again set and the next tone is sequence generated until an error occurs.

(FIG. 12. The start key is triggered If one of the impact sensor keys is struck, a determination is made to determine in step 1001 whether the proper entry, as dictated by the interactive program/game rules, has been struck. Based on this determination, in step 1002 either an error tone or a tone corresponding to the impact sensor key is sounded. At the same time, in step 1003 if the entry is proper the tone flag is set in step 1004, if not proper, in step 1005 an end of interactive program/game tone is sounded and in step 1006 a store tone series determination is made and in step 1007 tone series stored. If the entry is proper and the interactive program/game is not otherwise terminated, the tone flag is again set and the next tone is sequence generated (FIG. 13) until an error occurs.

Obviously, many modifications and variations of the disclosed embodiments are possible in light of the above teachings. Thus, it is to be understood that, within the scope of the appended claims, the invention may be practiced otherwise than as specifically described above.

Figure 14:
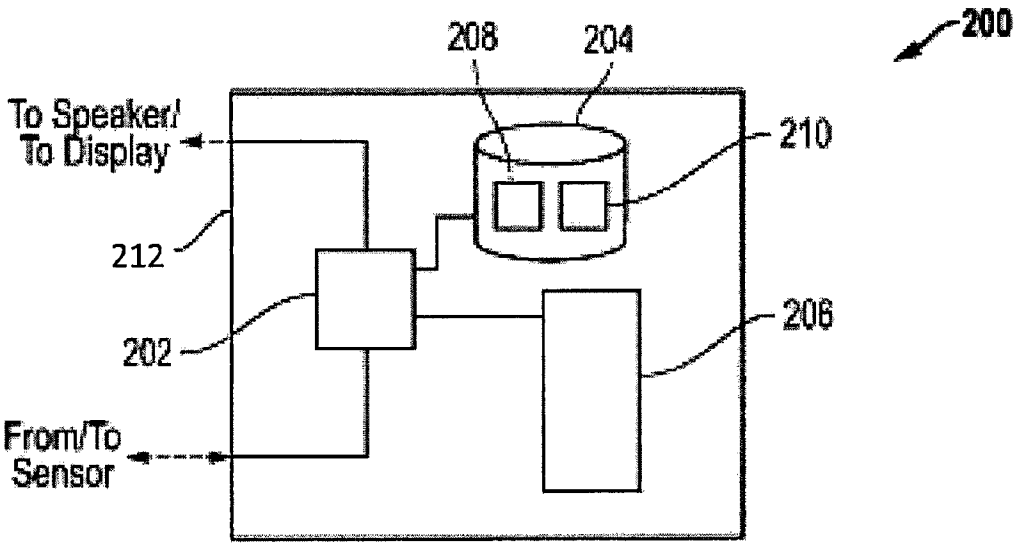
FIG. 14 illustrates a control unit of a striking apparatus, according to certain embodiments.

Referring to FIG. 14, an exemplary control unit 200, such as may be employed in the system 10, includes a controller 202 communicatively connected to one or more of the impact sensors 14, 16, 18, or 20. The controller 202 may be implemented in hardware circuit(s), software program(s), or combinations of these. An example of the controller 202 is a processor or other control circuit, or pluralities or combinations of these, operating a software program stored in a computer readable non-transitory memory. The controller 202 is communicatively connected to an output apparatus that is interpretable to the user, for example, a speaker (not shown in Figures). Memory 206 and data storage 204 are also connected to the controller 202 if a microprocessor or other circuit, for operation and store of the software program.

Figure 15:
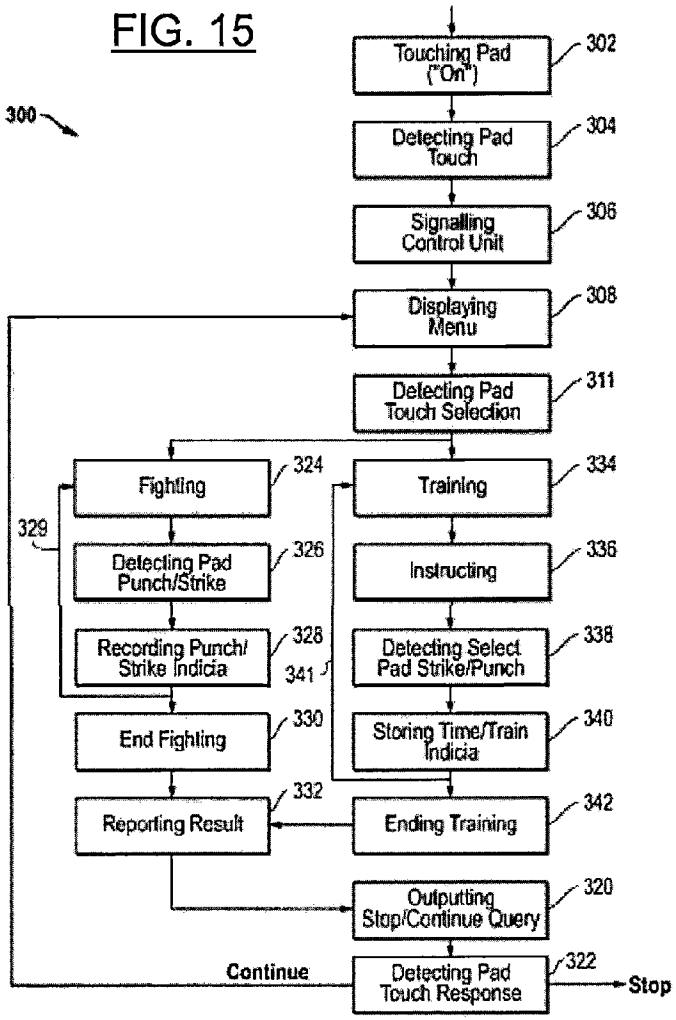
FIG. 15 illustrates a method of striking by a striking apparatus, according to certain embodiments of the invention.

Referring to FIG. 15, in conjunction with FIGS. 1 and 14, a method 300 of training such as may be performed by the system 10, of FIG. 1 when supplied with power, commences with a step 302 of touch impact to the pad 50. In certain embodiments, the step 302 is instigated through tap or touch of the pad 50, as compared to a strike to the pad 50.

In a step 304, the touch to the pad 50 in the step 302 is detected by the impact sensors 14, 16, 18, or 20, for the pad 50. The control unit 212 is signaled in a step 306 that the impact sensors 14, 16, 18, or 20, detected the touch to the pad 50. Upon the step 306, the control unit 212, in a step 308, controls an output device of the system 50, for example, a speaker, to provide an audible selection menu (not shown in Figures).

An item of the selection menu is chosen by user-input to the controller 600, for example, touch of the pad 50 (or a select one or more impact sensors 14, 16, 18, or 20, of the pad 50,), and the pad touch for the item selected is detected in a step 310. Examples of possible items which may be selected from the menu may include Fighting or Training, but are not limited to these, and may include others or alternatives, such as Coaching (not shown in Figures) or others. Once the item selection is detected in the step 310, the control unit 212 processes and commences a selected routine, e.g., fighting, training, or other sequence, per the selected menu item. Examples of possible routines include, for example, fighting sequences, training sequences, or others such as coaching sequences. Each routine is, for example, hardware logic circuits, a software routine stored in a computer readable non-transitory memory, or combinations of these, processed by the control unit 212.

If Fighting 324 is selected, fighting sequences are commenced in a step 324. In the step 324, the control unit 212 processes a fight module 208 (shown in FIG. 14 as software stored in the data storage 204, but which can alternately be a software routine stored in another computer readable non-transitory memory, hardware logic circuits, and/or combinations). The fight module 208 is processed in the step 324 by the control unit 212, to a speaker (not shown in figures). If the pad 50 is struck, the impact sensors 14, 16, 18, or 20, for the pad 50 detects the punch or strike in a step 326 and the control unit 212 is signaled of the detection. In a step 328, the control unit 212 registers one or more indicators of the strike or punch in response to the step 326.

The method 300 then proceeds with continued processing of the fight module 208 by the control unit 212 and output of additional fight sequences as shown by arrow 329 in FIG. 15, or otherwise the fight sequences are ended in a step 330. The fight sequences are ended in the step 330 either upon completed processing of the fight module 208 by the control unit 212 (such as at the end of a programmed routine of the module after fight sequences are output) or on receipt of an stop signal input to the control unit 212, for example, by an "off" or "end" mechanism of the system 600, such as through activation by a user of the system 600 of an off switch, entry of a key, striking in a particular sequence to the one or more pad 50, or other similar mechanism. Once processing of the fight module 208 is ended in the step 330, the control unit 212 reports a result in a step 332.

The result reported in the step 332 by the control unit 212 can be related via a speaker (not shown in figures). This can provide information of statistics of registered punch responses, measures of strike count, accuracy and force, and/or other measures or information, such as information related to outcomes of the fighting sequences, comparisons to earlier fighting results, or others. Further in the reporting step 332, the control unit 212 can store the reported information and/or additionally process the result together with prior results of usage of the system 600 to yield a statistical comparison record (which may, but need not necessarily, be stored by the control unit). In certain embodiments, the control unit 212 in the reporting step 332 may label the result (or a record of it) with a tag, such as an identifier of the particular user of the system 600, a time or date indicator of that use, or other indicators for viewing or comparison at later time or place.

If rather than Fighting 324, Training 334 is selected in the step 311, training sequences are commenced in the step 334. In the step 334, the control unit 212 processes a train module 210 (shown in FIG. 14 as software stored in the data storage 204, but which can alternately be a software routine stored in another computer readable non-transitory memory, hardware logic circuits, and/or combinations). The train module 210 is processed in the step 334 by the control unit 212 to output a depiction of the one or more pad 50 for audio results on speaker (not shown in figures) The output of the control unit 212 on processing of the train module 210 includes, for example, data sets or files suitable for displaying and/or audibly depicting the one or more pad 50 and a prescribed selection of sequential ones of the pad 50. As each pad 50 is selected in sequence, the pad 50 may subsequently be struck as training. Speed of sequential selection of the one or more pad 50 is controlled by the control unit 212 according to the processed train module 210. If any pad 50 is struck, the impact sensors 14, 16, 18, or 20, for the pad 50, detects the strike in a step 338 and the control unit 212 is signaled of the detection. In a step 340, the control unit 212 stores one or more indicators of the strike in response to the step 338.

The method 300 then proceeds with continued processing of the train module 210 by the control unit 212 and output of additional train sequences as shown by arrow 339 in FIG. 15, or otherwise the train sequences are ended in a step 342. The train sequences are ended in the step 342 either upon completed processing of the train module 210 by the control unit 212 (such as at the end of a programmed routine of the module after train sequences are output) or on receipt of an stop signal input to the control unit 212, for example, by an "off" or "end" mechanism of the system 100, such as through activation by a user of the system 100 of an off switch, entry of a key, striking in a particular sequence to the one or more pad 50, or other similar mechanism. Once processing of the train module 210 is ended in the step 330, the control unit 212 reports a result of the steps of Training 339 in a step 332.

As with the result reported in the step 332 by the control unit 212 on end of processing of the fight module 208, the result can be listened to via audio of the speaker 116. These results can provide information, such as with Fighting 324, of statistics of registered punch/strike responses, measures of strike/punch count, accuracy and force, and/or other measures or information, such as information related to outcomes of the fighting sequences, comparisons to earlier fighting results, or others. Further in the reporting step 332, the control unit 212 can store the reported information and/or additionally process the result together with prior results of usage of the system 600 to yield a statistical comparison record (which may, but need not necessarily, be stored by the control unit 212). The control unit 212 in the reporting step 332 may also label the result (or a record of it) with a tag in certain embodiments, such as an identifier of the particular user of the system 600, a time or date indicator of that use, or other indicators for reviewing or comparison at later time or place.

In effect, Fighting 324 occurs against the output avatar fighter. In the fight sequences, the avatar fighter moves, punches, strikes, and otherwise responds (albeit through lights within impact sensors 14, 16, 18, 20 or 22,) to a system user's strikes. Training 334, however, occurs through pad selection of the system and the user's strike of selected pad. Varied levels of competency of the user may be selected by the user or the system, such as Beginner, Intermediate, Advanced, Expert or others, through menu items displayed via output of the control unit 212 on selection for Fighting 324 or Training 334 (or at other point in use of the system). Moreover, real-time results of the user's strike actions may be displayed via output of the control unit 212 in either scenario. Real-time results may include, for example, strike Accuracy, Count, Power, and Points Scored. In certain embodiments, the control unit 212 includes modules for processing heart rate and/or calories used by the user of the system during Fighting 324 or Training 334. Various embodiments can provide for particular regimen of Rounds or Bouts, in follow-up sequence, such as would be encountered by the system user in practice or training for general exercise through striking. Other embodiments can allow for customization of the training sequences, such as increase or decrease of Rounds, time of Rounds or Bouts, different sequences or times according to day of the week or period, adjustment of output volume, selection among specific Rounds or variation of sequences per Round, and custom routines operable by the control unit in the system.

Figure 16:
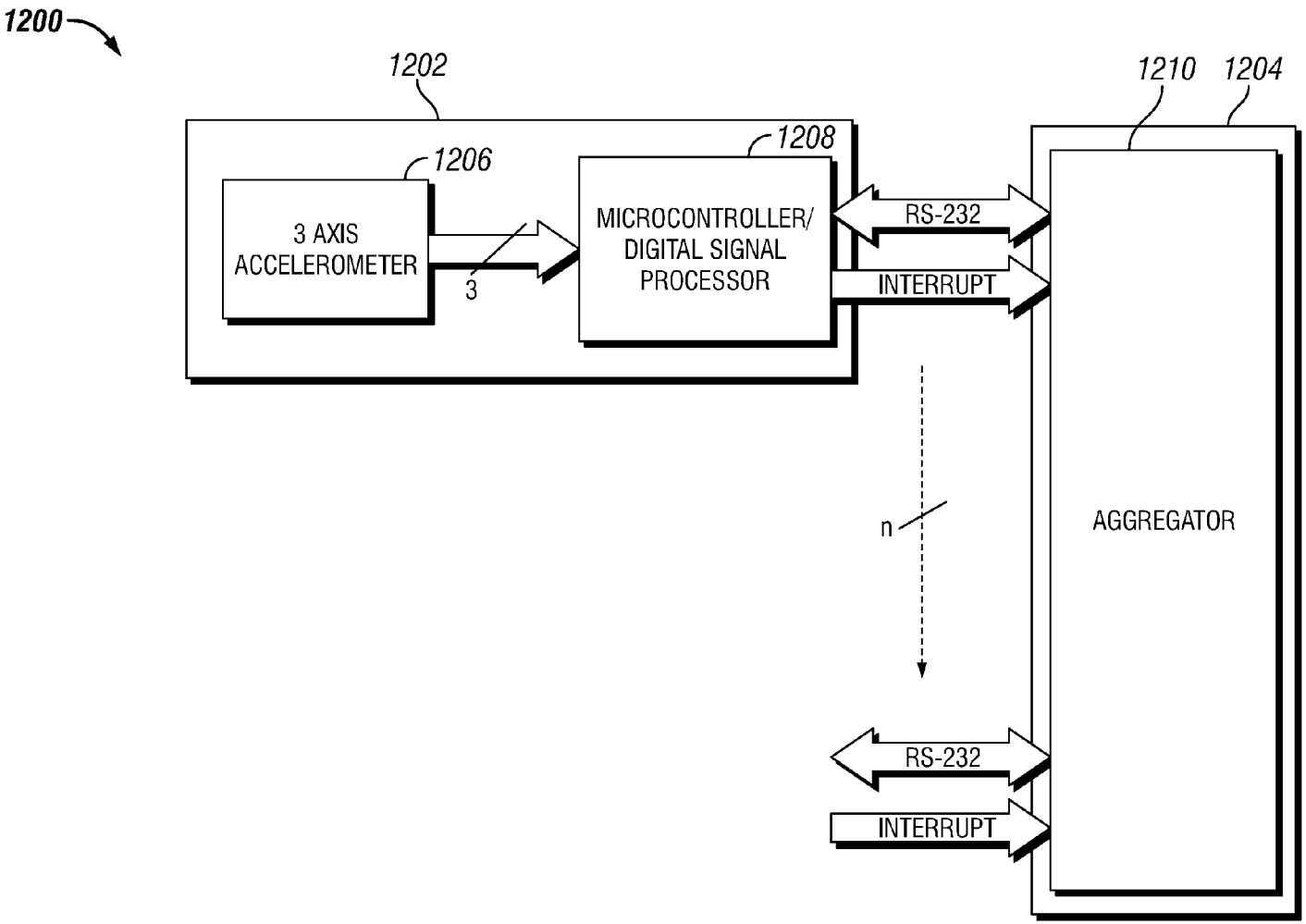
FIG. 16 illustrates an exemplary sensor device of a striking apparatus, according to certain embodiments of the invention.

As illustrated in the embodiment of FIG. 16, a system 1200 for detecting contact, such as a strike includes an accelerometer unit 1202 communicatively connected to an aggregator unit 1204. The accelerometer unit 1202 includes an accelerometer 1206 communicatively connected to a signal processor 1208. The aggregator unit 1204 includes an aggregator device 1210, which includes or is communicatively connected to a processor (not shown in detail).

In some embodiments, the accelerometer 1206 is, for example, a 3-axis accelerometer for detecting three dimensions of movement (e.g., X, Y and Z axes, respectively). In other embodiments, the accelerometer 1206 is alternately a single-axis or multi-axis of other number of dimensions, and the 3-axis accelerometer is merely an example for purposes of discussion. The signal processor 1208 is any of a wide variety of processor device, such as a microcontroller, digital signal processor, or other processor, capable of processing measurements in the three (or other number of) dimensions made by the accelerometer 1206. The accelerometer unit 1202 can be unitized, such as a single printed circuit board including the accelerometer 1206 and the signal processor 1208, or may be implemented in separate units, other segregation of components, or any combination of units, features of units or components.

The aggregator device 1210 of the aggregator unit 1204 includes memory and a processor (not shown in detail). The aggregator device 1210 is, for example, a microcontroller chip unit including a processor, random access memory, read only memory, clock and input/output control unit. Although the aggregator device 1210 can be unitized as a single chip or unit, it may alternately be implemented in communicatively connected separate components, units of various components, or combinations.

In operation of some embodiments, the accelerometer 1206 measures axial acceleration, in three dimensions (X, Y, and Z) in the example. Measurements are sampled at successive time intervals, for example, at approximately 1 millisecond (ms) intervals, or as otherwise desired by design or for the application. Each measurement made by the accelerometer 1206 includes three axis values in the example of the 3-axis accelerometer, and this measurement is communicated to the signal processor 1208.

In some embodiments, if measurement by the accelerometer 1206 exceeds a minimum threshold sufficient to indicate a strike moving the accelerometer 1206, the signal processor 1208 commences calculating the root mean square of the three axis values for each measurement of the accelerometer 1206, to obtain a vector sum magnitude. The signal processor 1208 continues this calculating with each next measurement of the accelerometer 1206 received by the signal processor 1208. As the signal processor 1208 receives measurements and performs root mean square calculations, the signal processor 1208 also commences integrating the vector sum magnitude. The result of integrating is reflects the merit or force of movement/acceleration, for example, such as may be caused by the strike, because relative to magnitude and duration of acceleration measured by the accelerometer 1206. The signal processor 1208 also determines one of the axes measured as dominant for the movement/acceleration, such as the dominant axial direction of the strike. For the dominant axis so determined, the signal processor 1208 integrates the result of integration of the vector sum magnitude to calculate a velocity for the dominant axis. The signal processor 1208 continues the calculating and integrating of measurements from the accelerometer 1206, until the dominant axis velocity integral drops below a lower threshold value.

In some embodiments, when the lower threshold value is met, the signal processor 1208 communicates an interrupt request (IRQ) to the aggregator device 1210. The aggregator device 1210 time stamps the interrupt request, and requests and receives from the signal processor 1208 data representing the dominant axis velocity integral and identity of dominant axis. The aggregator device 1210 stores data representing this integral and axis in a non-transitory memory of the aggregator device 1208 (or, alternately, of memory communicatively connected to the aggregator device 1208, as applicable).

Figure 17:
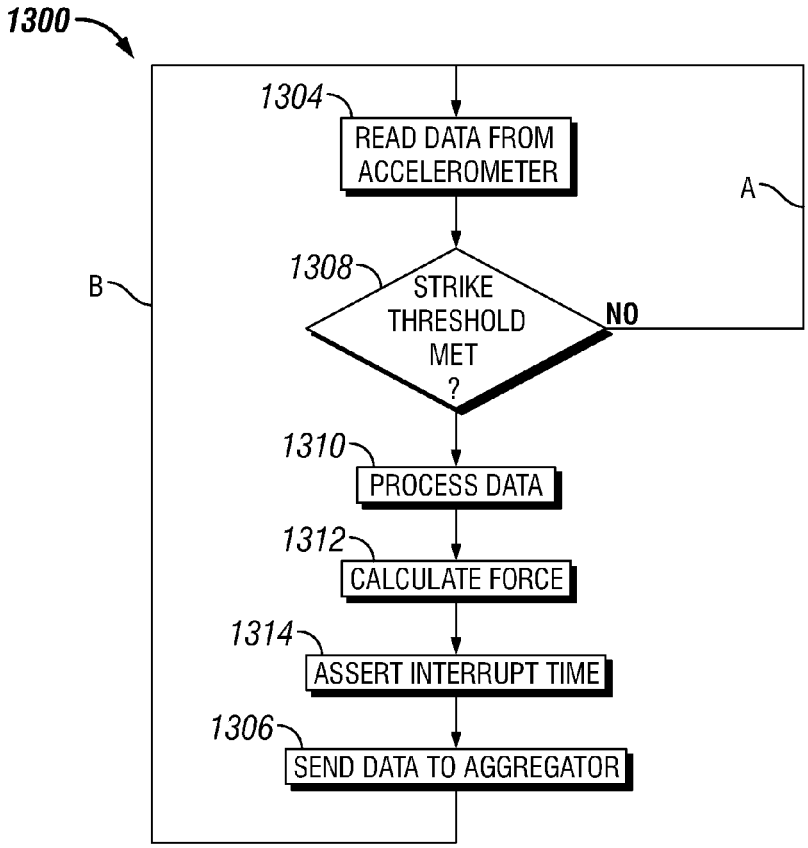
FIG. 17 illustrates a method of detecting a strike or touch to a pad of a striking apparatus, according to certain embodiments of the invention.

Referring to FIG. 17, in conjunction with FIG. 16, a method 1300 of strike detection to a pad incorporated with an accelerometer, such as performed, for example, by the signal processor 1208, includes a step of reading 1304 strike data received from an accelerometer. The step of reading 1304 may be commenced, as previously mentioned, on receipt of an interrupt from the accelerometer, and includes a request and receipt of data representing accelerometer axial measurements upon a strike to the pad. In a step 1308, determination is made whether received data meets a threshold.

As illustrated in FIG. 17, if the threshold is not met, the method 1300 returns to the step of reading 1304. If, however, determination in the step 1308 is that the threshold is met, a step of processing 1310 the root mean square of data representing the accelerometer axial measurements proceeds to obtain a vector sum magnitude corresponding to the measurements. This step of processing 1310 continues for each next set of data representing accelerometer axial measurements, for example, throughout the strike detected by the accelerometer (e.g., until a threshold is met, such as for the axis velocity integral previously mentioned).

In a step of calculating force 1312, each set of results of the step of processing 1310 is integrated to obtain a measured merit for the strike, a dominant dimensional axis of the strike, and highest magnitude of the acceleration. The measured merit for the strike relates to the magnitude and duration of acceleration as detected by the accelerometer for the period of the strike from commencement (on meeting one threshold) and on end (on meeting another threshold). Further in the step 1312, acceleration for the dominant axis of the strike is integrated to obtain velocity for the axis and strike.

In a step 1314, an interrupt line is asserted when the dominant axis velocity integral in the step 1312 drops below the end threshold, as set for measuring the strike. Upon asserting the interrupt line 1314, data from the step of calculating force 1312 is sent to an aggregator for logging and further handling. This data represents, for example, a time of the strike, an identity of a pad of the strike, a measured merit of the strike in the nature of a relative force of the strike, and the dominant dimensional axis of the strike indicative of strike direction.

Other, additional or alternative calculations and data representing the strike or strike attributes may be performed in the method 1300, as will be appreciated from the foregoing. For example, force and resistance constants, such as of mechanical features like springs or joints, processed mathematical models, or other detection and measurement may, in certain alternatives, be employed in the method 1300 for measuring force, direction, duration, and the like.

In use of the embodiments of FIGS. 16-17 in a striking apparatus of the embodiments, the pad of the striking apparatus (as to which strikes are to be measured) includes a particular one of the accelerometer unit 1202. Each accelerometer unit 1202, if one or more each incorporated in particular pads, is communicatively connected to the aggregator unit 1204. In certain examples, each accelerometer unit 1202 is a small printed circuit board including the accelerometer device 1206 and the signal processor 1208 and the aggregator unit 1204 is same for all one or more accelerometer unit 1202 for respective pads. The aggregator unit 1204, for example, is included in a control unit for the striking apparatus of the embodiments, or can be included or incorporated in other components or functional devices of the control unit, in one or more printed circuit board connected to other elements of the control unit, or in other segregations or combinations.

Each accelerometer unit 1202 independently measures and calculates data representing strikes to one or more pad to which the accelerometer unit 1202 is integrated or connected. Where more than one accelerometer unit 1202, such as when multiple pads of the striking apparatus, each accelerometer unit 1202 detects a strike to the particular pad to which associated, and delivers data representing the strike to the aggregator unit 1204. The aggregator 1210, as previously stated, logs the strike (i.e., data representing the strike) together with the timestamp per the interrupt request and orderly stores these in memory (of the aggregator 1210, if applicable, or otherwise communicatively connected to the aggregator 1210). Successive strikes are logged in the order in which interrupts are received by the aggregator 1210 and corresponding to the particular pad of the strike.

Figure 18:
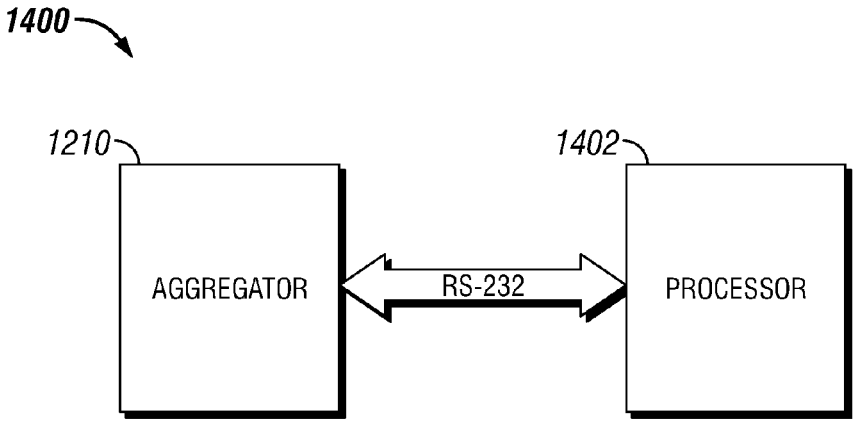
FIG. 18 illustrates an example of a control unit of a striking apparatus, including an aggregator and processor, according to certain embodiments of the invention.

Referring to FIG. 18, in conjunction with FIGS. 16 and 17, the aggregator 1210 is communicatively connected to a processor 1402, for example, a control unit 1400 of a striking apparatus according to embodiments, for controlling reporting, display, and other output, as well as storage of data representing user actions and activities using the striking apparatus in a non-transitory tangible media or other medium. After a particular time interval for the log entry of the aggregator 1210, the aggregator 1210 communicates the log entry to a control unit, such as a processor and other devices, of the striking apparatus. The control unit, as described with respect to embodiments, employs data of the log entry for reporting output to the user, for example, strike accuracy, number power and other striking and training output in a display of the striking apparatus. Additionally, the striking apparatus may store such reported output for the user, such as to allow tracking of progress and the like.

An example according to certain embodiments is now described.

Example of Accelerometer Data Acquisition:

In one embodiment, the bandwidth of accelerometer signal, sampling rate (e.g., 1 ms intervals or other time periods), and particular axes sampled (e.g., X, Y, Z axes in the case of a 3-axis accelerometer) are set as desired for the operations in accordance with accelerometer capabilities. Sampled raw data of the accelerometer is low-pass filtered to reduce effect of noise, for example, using a 4-point rolling average filter Calculations are made for each axis (e.g., 3-axes, to with, X, Y and Z) after the data of each sample is demodulated, as follows: $X'=(X_0+X_1+X_2+X_3)/4$, where $X_0$ is the oldest raw data and $X_3$ is the newest raw data. After this calculation, X' is stored in a large data buffer and $X_0$ it discarded. A next raw data ($X_4$) is then sampled at a later designated time interval (e.g., sampling at 1 ms intervals) Calculations are then made for each axis as follows: $X''=(X_0+X_1+X_2+X_3)/4$ Where $X_1$ is the oldest raw data and $X_3$ is the newest raw data. After this calculation X" is stored in the data buffer and $X_1$ is discarded. Subsequent sampling and calculations continue for each accelerometer. If there is more than one pad of the striking apparatus, and each pad includes an accelerometer, the data acquisition continues in similar manner with respect to each accelerometer.

Example of Strike Detection

In one embodiment, a respective acceleration vector sum of the X, Y, and Z axis acceleration data sampled by a respective accelerometer is calculated, for example, by a signal processor of an accelerometer unit, as the root mean square of the axis acceleration data. If the vector sum exceeds a pre-determined threshold, a strike is deemed detected for the particular accelerometer and corresponding pad of the striking apparatus. Sampling continues, and sampled data is smoothed and vector sum calculated and stored, until the vector sum falls below a second pre-determined threshold. At this point a strike metric calculation is performed.

Example of Strike Metric Calculation

In one embodiment, the time period of the strike, and consequently of sampling and calculation of sampled strike data measured by the accelerometer as acceleration vectors along the applicable axes, commences at the time the vector sum exceeds the first threshold and ends at the time the vector sum falls below the second threshold. Calculations are performed for the sampled data, for example, by a signal processor of an accelerometer unit. A peak magnitude (i.e., Acceleration Peak) of the vector sum is determined from the respective vector sums calculated. A direction of the vector at the Acceleration Peak is calculated and saved as the azimuth and the inclination.

The azimuth is calculated from Z and Y axis data. Z is positive acceleration when the pad is hit in or out. Y has positive acceleration when the pad is hit left to right. Zero (0) degrees is when there is positive Z acceleration with a Y acceleration value of 0. 90 degrees is when Z acceleration is 0 and Y acceleration is positive. 180 degrees is pad acceleration in the Z-axis of the pad returning to a position at which normally disposed by the frame of the striking apparatus when not struck, and Y acceleration is zero.

Inclination is the angle formed by the X and Z axes. 0 degrees is when the X acceleration is positive and the Z acceleration is 0. 90 degrees is when the X acceleration is zero and the Z acceleration is positive. 190 degrees is when the X acceleration is negative and the Z acceleration is zero. In this embodiment, the vector sums from samples by the accelerometer during the time period of the strike (i.e., between first and second threshold) are then integrated to obtain a maximum velocity of the strike (i.e., Total Energy), which has relation to the total energy transferred to the pad by the strike. Each vector sum that was calculated is multiplied by the interval of the sample period (e.g., 1 ms or other interval), and each product of that multiplication is summed as a measure of total work for the strike (i.e., Total Work). The following strike metrics are then communicated to an aggregator for the metrics: Acceleration Peak, Direction, Total Work, and Total Energy. Strike Aggregator: The aggregator monitors interrupt request lines (IRQ) from each accelerometer of each pad of the striking apparatus for which strikes are detected. When an IRQ line is asserted, a timestamp is logged by the aggregator. The aggregator then requests the strike metrics data from the applicable accelerometer unit of the stricken pad. When the aggregator receives strike metrics data from multiple different accelerometer units, the order of receipt is saved in memory with 1 ms (or other interval) resolution and the strike metrics data is requested from each respective accelerometer unit in turn. Strike metric data for each particular accelerometer unit from which received is stored in chronological order, together with a corresponding identifier of the pad of the accelerometer unit (e.g., via a pad number). Strike metric data that remains stored for a particular period (e.g., 25 ms or other period) is deemed valid to indicate a strike, as opposed to random movement of pads, affected signals, minor missed or random hits to pads, or the like. Valid strike metrics data is communicated to other features of the control unit of the striking apparatus, for further processing, display, audio or visual output, storage, or other operations. Pause Detection: A pause, such as may be invoked by a user desiring to halt striking with the striking apparatus for an interim period, can be directed by the user, for example, by a particular strike of pad(s) or, according to design, by other user-initiated contact with the pads, display, switch, or other features of the apparatus. As an example, a pause may occur when the aggregator detects a particular simultaneous strike to two pads (e.g., simultaneous strike of "kidney" pads of the apparatus). To reduce the possibility of false detections leading to a pause, the aggregator may check the detections against certain programmed or hardware parameters. In one possible example in which strike to two particular pads initiates the pause, only if those two pads have accumulated a calculated work value falling within a particular higher range and other pads have accumulated a calculated work value falling only within a particular lower range, is the pause indicated. In the event that a pause is detected, according to certain embodiments, the aggregator communicates a pause command to the control unit, followed by the strike metrics data associated with the pause command. In other examples, a pause, even if indicated by testing of parameters, may not be initiated if other control devices, such as of the control unit of the striking apparatus, so dictate. Of course, other variations are possible for pause and pause detection, as will be understood from this disclosure and recognized by a person of ordinary skills in the art.

Figure 19:
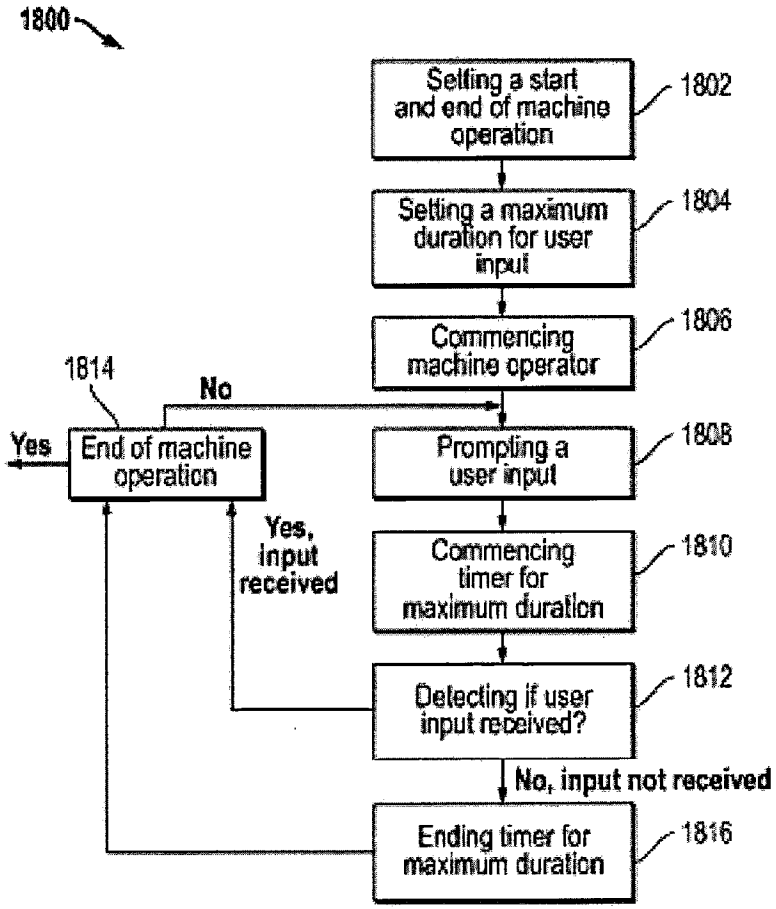
FIG. 19 illustrates a method of varying pace of a routine in a striking apparatus to accommodate a user providing excessively slow or fast strike responses, according to certain embodiments of the invention.

Referring now to FIG. 19, a method 1800 paces a machine's operations to accommodate a user's input. For purposes of example and discussion, the method 1800 is described with respect to a striking apparatus of embodiments; however, similarities to other machines will be understood and are therefore intended as included for purposes of embodiments. The method 1800 commences with a step 1802 of setting a start and end of operation, for example, selecting a routine of the striking apparatus of set duration. In a step 1804, a maximum time duration is set for receipt of user input to a pad, such as a maximum time for a user's strike or punch in response to direction for strike of a pad by the striking apparatus. The striking apparatus is commenced operating in a step 1806.

As the striking apparatus operates, such as according to a routine of the apparatus, the striking apparatus prompts user input to a designated pad in a step 1808. Upon the step of prompting user input 1808, the apparatus commences timing in a step 1810 for a period of the maximum duration and also detecting in a step 1812 to determine if any input of the user is received in accordance with the direction for input. If user input is detected in the step 1812 prior to the end of the step of timing 1810 for the maximum duration, a step 1814 checks if the striking apparatus operation is completed, such as on completion of the routine of the apparatus. If not completed, the method 1800 returns to the step of prompting user input 1808 in accordance with the operation, such as per the routine. If the machine operation is completed, such as at end of the striking routine, the method 1800 ends. Where user input is not detected in the step 1812 prior to reaching the end of the maximum duration of the step of timing 1810, timing ends and the method 1800 proceeds to the step 1814 to determine if the operation or routine is completed. If not, the method 1800 returns to the step of prompting use input 1808, and if operation is completed, the method 1800 ends.

The method 1800 may be implemented by a software program stored in tangible media, a processor, a computer, electric circuits, or any combinations of these. As one possible example, the method 1800 is a software program stored in tangible media of a control unit of the striking apparatus. The software program is operated by a processor and memory of the control unit. Alternately, the method 1800 can be implemented and operated by other devices and components of the striking apparatus, or via control through communicative connection of the striking apparatus with another source, such as a computer or processing device having access to the software program or components of the striking apparatus or peripheral equipment. Variations in operations of the striking apparatus in accordance with the method 1800 can alter various features and results, for example, if pace of operation is slowed, pad prompts through highlight in the display are adjusted in coordination with the slowed pace, and vice versa for variation to faster pace. In alternatives, the striking apparatus, because of the timestamps and logging of strike data and calculation of metrics, can as necessary process and display a user's actual pace compared to an apparatus directed pace according to the particular routine and can deliver as output for display, audio, visual or otherwise warning or similar signals.

While the foregoing embodiments have been described herein with a certain degree of particularity, the embodiments were disclosed by way of example only, and that numerous changes in the detailed construction and the combination and arrangement of parts may be resorted to without departing from the spirit and scope of the invention as hereinafter claimed.

I claim:

1. A portable exercise apparatus comprising:

a speed bag assembly comprising:

a support arm having a first end and a second end;

a speed bag platform connected to the first end of the support arm;

a speed bag connected to the speed bag platform;

a speed bag column having a top end and a bottom end;

wherein the second end of the support arm is adjustably connected to the top end of the speed bag column;

a striking pad assembly comprising:

a striking pad having a top surface, a bottom surface, a non-striking surface, a central bore extending between the top surface and the bottom surface, and a longitudinal indentation extending between the top surface and the bottom surface and centrally along the non-striking surface, the longitudinal indentation configured to conform against angled walls of a firm structure;

wherein the central bore comprise an inward extending protrusion; and a striking pad column having a top end, a bottom end, and a plurality of outward extending protrusions;

wherein the outward extending protrusions of the striking pad column are configured to engage the inward extending protrusion of the central bore of the striking pad; and wherein the top end of the striking pad column slideably receives the bottom end of the speed bag column;

a support column having a top end, a bottom end, and a plurality of apertures, wherein the top end of the support column is connected to the bottom end of the striking pad column; and a base unit having a plurality of legs and a hollow coupler for adjustably receiving the bottom end of the support column;

wherein the legs of the base unit are configured to optimally press the portable exercise apparatus against the angled walls of the firm structure as the sole means of stabilization; and wherein the hollow coupler comprises an aperture used to connect the base unit to the support column through a selective aperture from the support column's plurality of apertures.

2. The portable exercise apparatus of claim 1, further comprising means for converting the striking pad assembly to a heavy striking bag.

3. The portable exercise apparatus of claim 1, further comprising means for converting the portable exercise apparatus to a hand held striking pad.

4. A portable exercise apparatus comprising:

a speed bag assembly comprising:

a support arm having a first end and a second end;

a speed bag platform connected to the first end of the support arm;

a speed bag connected to the speed bag platform;

a speed bag column having a top end and a bottom end;

wherein the second end of the support arm is adjustably connected to the top end of the speed bag column;

a striking pad assembly comprising:

a striking pad having a striking surface, a non-striking surface, a top surface, a bottom surface, a central bore extending between the top surface and the bottom surface, and a longitudinal indentation extending between the top surface and the bottom surface and centrally along the non-striking surface, the longitudinal indentation configured to conform against angled walls of a firm structure;

wherein the central bore of the striking pad comprises an inward extending protrusion; and a striking pad column having a top end, a bottom end, and a plurality of outward extending protrusions;

wherein the outward extending protrusions of the striking pad column are configured to engage the inward extending protrusion of the central bore of the striking pad; and wherein the top end of the striking pad column slideably receives the bottom end of the speed bag column; and an interactive program unit comprising:

a plurality of impact sensors operatively connected to the striking surface of the striking pad;

a plurality of strike triggers each of which uniquely associated with a respective impact sensor from the plurality of impact sensors;

a memory for storing a plurality of interactive exercise programs;

a control unit having a plurality of switches used to select an interactive exercise program from the plurality of interactive exercise programs;

a microprocessor operatively connected between the impact sensors, the strike triggers, and the control unit to facilitate the selected interactive exercise program;

a support column having a top end, a bottom end, and a plurality of apertures, wherein the top end of the support column is connected to the bottom end of the striking pad column;

a base unit having a plurality of legs and a hollow coupler for adjustably receiving the bottom end of the support column;

wherein the legs of the base unit are configured to optimally press the portable exercise apparatus against the angled walls of the firm structure as the sole means of stabilization; and wherein the hollow coupler comprises an aperture used to secured the base unit to the support column through a selective aperture of the support column's plurality of apertures.

5. The portable exercise device of claim 4, wherein the interactive program unit further comprises a speaker connected to the microprocessor, and wherein each strike trigger from the plurality of strike triggers is a distinct audio cue uniquely associated with the respective impact sensor.

6. The portable exercise device of claim 5, wherein the microprocessor is configured to receive a signal from the control unit that identifies the selected interactive exercise program from the plurality of interactive exercise programs stored on the memory, and is further configured to utilize the speaker to sound the distinct audio cues in a predetermined sequence according to the selected interactive exercise program.

7. The portable exercise device of claim 4, wherein the interactive program unit further comprises a multi-color light emitting means connected to the microprocessor, and wherein each strike trigger from the plurality of strike triggers is a distinct visual cue uniquely associated with the respective impact sensor.

8. The portable exercise device of claim 7, wherein the microprocessor is configured to receive a signal from the control unit that identifies the selected interactive exercise program from the plurality of interactive exercise programs stored on the memory, and is further configured to utilize the multi-color light emitting means to emit the distinct visual cues in a predetermined sequence according to the selected interactive exercise program.

9. The portable exercise device of claim 4, wherein:

the portable exercise device further comprises:

means for converting the striking pad assembly to a heavy striking bag; and means for converting the portable exercise apparatus to a hand held striking pad; and wherein the interactive program unit further comprises:

a speaker connected to the microprocessor;

a multi-color light emitting means connected to the microprocessor; and wherein each strike trigger from the plurality of strike triggers is at least one of:

a distinct audio cue uniquely associated with the respective impact sensor and a distinct visual cue uniquely associated with the respective impact sensor.

10. The portable exercise device of claim 9, wherein the microprocessor is configured to receive a signal from the control unit that identifies the selected interactive exercise program from the plurality of interactive exercise programs stored on the memory, and is further configured to utilize the speaker and the multi-color light emitting means to emit a predetermined combination of the distinct audio cues and distinct visual cues in a predetermined sequence according to the selected interactive exercise program.

11. The portable exercise device of claim 10, wherein the interactive program unit further comprises:

means for measuring punch strength;

means for measuring response time;

means for selecting an error criteria for the selected interactive exercise program;

means for determining whether the error criteria has been met; and wherein the microprocessor is further configured to utilize at least one of the speaker and the multi-color light emitting device to indicate that the error criteria has been met.

12. A portable exercise apparatus comprising:

a speed bag assembly comprising:

a support arm having a first end and a second end;

a speed bag platform connected to the first end of the support arm;

a speed bag connected to the speed bag platform;

a speed bag column having a top end and a bottom end;

wherein the second end of the support arm is adjustably connected to the top end of the speed bag column;

a striking pad assembly comprising:

a striking pad having a striking surface, a non-striking surface, a top surface, a bottom surface, a central bore extending between the top surface and the bottom surface, and a longitudinal indentation extending between the top surface and the bottom surface and centrally along the non-striking surface, the longitudinal indentation configured to conform against angled walls of a firm structure;

wherein the central bore of the striking pad comprises an inward extending protrusion; and a striking pad column having a top end, a bottom end, and a plurality of outward extending protrusions;

wherein the outward extending protrusions of the striking pad column are configured to engage the inward extending protrusion of the central bore of the striking pad; and wherein the top end of the striking pad column slideably receives the bottom end of the speed bag column; and an interactive program unit comprising:

a first set of impact sensors operatively connected to the striking surface of the striking pad;

a second set of impact sensors operatively connected to the speed bag;

a first set of strike triggers each of which uniquely associated with a respective impact sensor from the first set of impact sensors;

a second set of strike triggers each of which uniquely associated with a respective impact sensor from the second set of impact sensors;

a memory for storing a plurality of interactive exercise programs;

a control unit having a plurality of switches used to select an interactive exercise program from the plurality of interactive exercise programs;

a microprocessor operatively connected between the first and second sets of impact sensors, the first and second sets of strike triggers, and the control unit to facilitate the selected interactive exercise program;

a support column having a top end, a bottom end, and a plurality of apertures, wherein the top end of the support column is connected to the bottom end of the striking pad column;

a base unit having a plurality of legs and a hollow coupler for adjustably receiving the bottom end of the support column;

wherein the legs of the base unit are configured to optimally press the portable exercise apparatus against the angled walls of the firm structure as the sole means of stabilization; and wherein the hollow coupler comprises an aperture used to secured the base unit to the support column through a selective aperture of the support column's plurality of apertures.

13. The portable exercise device of claim 12, wherein the interactive program unit further comprises a speaker connected to the microprocessor, and wherein each strike trigger from the first and second sets of strike triggers is a distinct audio cue uniquely associated with the respective impact sensor.

14. The portable exercise device of claim 13, wherein the microprocessor is configured to receive a signal from the control unit that identifies the selected interactive exercise program from the plurality of interactive exercise programs stored on the memory, and is further configured to utilize the speaker to sound the distinct audio cues in a predetermined sequence according to the selected interactive exercise program.

15. The portable exercise device of claim 12, wherein the interactive program unit further comprises a multi-color light emitting means connected to the microprocessor, and wherein each strike trigger from the first and second sets of strike triggers is a distinct visual cue uniquely associated with the respective impact sensor.

16. The portable exercise device of claim 15, wherein the microprocessor is configured to receive a signal from the control unit that identifies the selected interactive exercise program from the plurality of interactive exercise programs stored on the memory, and is further configured to utilize the multi-color light emitting means to emit the distinct visual cues in a predetermined sequence according to the selected interactive exercise program.

17. The portable exercise device of claim 12, wherein the interactive program unit further comprises:

a speaker connected to the microprocessor;

a multi-color light emitting means connected to the microprocessor; and wherein each strike trigger from the first and second sets of strike triggers is at least one of:

a distinct audio cue uniquely associated with the respective impact sensor and a distinct visual cue uniquely associated with the respective impact sensor.

18. The portable exercise device of claim 17, wherein the microprocessor is configured to receive a signal from the control unit that identifies the selected interactive exercise program from the plurality of interactive exercise programs stored on the memory, and is further configured to utilize the speaker and the multi-color light emitting means to emit a predetermined combination of the distinct audio cues and distinct visual cues in a predetermined sequence according to the selected interactive exercise program.

19. The portable exercise device of claim 18, wherein the interactive program unit further comprises:

means for selecting an error criteria for the selected interactive exercise program;

means for determining whether the error criteria has been met; and wherein the microprocessor is further configured to utilize at least one of the speaker and the multi-color light emitting device to indicate that the error criteria has been met.

20. The portable exercise device of claim 19, wherein:

the interactive program unit further comprises:

means for measuring punch strength;

means for measuring response time; and means for communicating the measured punch strength and response time; and wherein the portable exercise device further comprises:

means for converting the striking pad assembly to a heavy striking bag; and means for converting the portable exercise apparatus to a hand held striking pad.

* * * * *